US008280743B2

(12) United States Patent
Seefeldt et al.

(10) Patent No.: US 8,280,743 B2
(45) Date of Patent: Oct. 2, 2012

(54) CHANNEL RECONFIGURATION WITH SIDE INFORMATION

(75) Inventors: Alan Jeffrey Seefeldt, San Francisco, CA (US); Mark Stuart Vinton, San Francisco, CA (US); Charles Quito Robinson, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 801 days.

(21) Appl. No.: 11/999,159

(22) Filed: Dec. 3, 2007

(65) Prior Publication Data

US 2008/0097750 A1 Apr. 24, 2008

Related U.S. Application Data

(63) Continuation of application No. PCT/US2006/020882, filed on May 26, 2006.

(60) Provisional application No. 60/711,831, filed on Aug. 26, 2005, provisional application No. 60/687,108, filed on Jun. 3, 2005.

(51) Int. Cl.
*G10L 21/04* (2006.01)

(52) U.S. Cl. ..... 704/500

(58) Field of Classification Search ..... 704/500–504
See application file for complete search history.

(56) References Cited

U.S. PATENT DOCUMENTS

| | | | | |
|---|---|---|---|---|
| 4,464,784 | A | 8/1984 | Agnello | |
| 4,624,009 | A | 11/1986 | Glenn et al. | |
| 5,040,081 | A | 8/1991 | McCutchen | |
| 5,235,646 | A | 8/1993 | Wilde et al. | |
| 5,812,971 | A * | 9/1998 | Herre | 704/230 |
| 5,862,228 | A | 1/1999 | Davis | |
| 6,021,386 | A | 2/2000 | Davis et al. | |
| 6,211,919 | B1 | 4/2001 | Zink et al. | |
| 6,430,533 | B1 | 8/2002 | Kolluru et al. | |
| 7,283,954 | B2 | 10/2007 | Crockett et al. | |
| 7,313,519 | B2 | 12/2007 | Crockett | |
| 7,394,903 | B2 * | 7/2008 | Herre et al. | 381/23 |
| 2001/0027393 | A1 | 10/2001 | Touimi et al. | |
| 2001/0038643 | A1 | 11/2001 | McFarland | |
| 2004/0037421 | A1 | 2/2004 | Truman | |
| 2004/0044525 | A1 | 3/2004 | Vinton et al. | |
| 2004/0122662 | A1 | 6/2004 | Crockett | |
| 2004/0148159 | A1 | 7/2004 | Crockett et al. | |
| 2004/0165730 | A1 | 8/2004 | Crockett | |
| 2004/0184537 | A1 | 9/2004 | Geiger et al. | |

(Continued)

FOREIGN PATENT DOCUMENTS

EP 0 372 155 A2 6/1990

(Continued)

OTHER PUBLICATIONS

Brandenburg, K., "MP3 and AAC Explained," Proceedings of the International AES Conference, 1999, pp. 99-110.

(Continued)

*Primary Examiner* — Abul Azad

(57) ABSTRACT

During production, at least one audio signal is processed in order to derive instructions for channel reconfiguring it. The at least one audio signal and the instructions are stored or transmitted. During consumption, the at least one audio signal is channel reconfigured in accordance with the instructions. Channel reconfiguring includes upmixing, downmixing, and spatial reconfiguration. By determining the channel reconfiguration instructions during production, processing resources during consumption are reduced.

27 Claims, 6 Drawing Sheets

U.S. PATENT DOCUMENTS

| | | | | |
|---|---|---|---|---|
| 2005/0058304 | A1* | 3/2005 | Baumgarte et al. | 381/98 |
| 2005/0078840 | A1 | 4/2005 | Riedl | |
| 2006/0002572 | A1 | 1/2006 | Smithers et al. | |
| 2006/0029239 | A1 | 2/2006 | Smithers | |
| 2006/0085200 | A1* | 4/2006 | Allamanche et al. | 704/500 |
| 2007/0140499 | A1 | 6/2007 | Davis | |

FOREIGN PATENT DOCUMENTS

| | | | |
|---|---|---|---|
| EP | 0 525 544 | A2 | 2/1993 |
| JP | 8-502157 | | 3/1996 |
| JP | 10074097 | | 3/1998 |
| JP | 2004-078183 | | 3/2004 |
| WO | WO 91/19989 | | 12/1991 |
| WO | WO 91/20164 | | 12/1991 |
| WO | WO 98/20482 | | 5/1998 |
| WO | WO 99/29114 | | 6/1999 |
| WO | WO 99/57941 | | 11/1999 |
| WO | WO 00/19414 | | 4/2000 |
| WO | WO 00/45378 | | 8/2000 |
| WO | WO 02/15587 | | 2/2002 |
| WO | WO 02/084645 | | 10/2002 |
| WO | WO 02/093560 | | 11/2002 |
| WO | WO 02/097790 | | 12/2002 |
| WO | WO 02/097791 | | 12/2002 |
| WO | WO 02/097792 | | 12/2002 |
| WO | WO 03/069954 | | 8/2003 |
| WO | WO 03/090208 | | 10/2003 |
| WO | WO 2004/019656 | | 3/2004 |
| WO | WO 2004/073178 | | 8/2004 |
| WO | WO 2004/111994 | | 12/2004 |
| WO | 2005036925 | | 4/2005 |
| WO | WO 2005/086139 | | 9/2005 |
| WO | WO 2006/006977 | | 1/2006 |
| WO | WO 2006/019719 | | 2/2006 |
| WO | WO 2006/113047 | | 10/2006 |
| WO | WO 2006/113062 | | 10/2006 |
| WO | WO 2006/132857 | | 12/2006 |
| WO | WO 2007/016107 | | 2/2007 |
| WO | WO 2007/127023 | | 11/2007 |

OTHER PUBLICATIONS

Carroll, Tim, "Audio Metadata: You Can Get There from Here," Oct. 11, 2004, pp. 1-4, Retrieved from the Internet: URL:http://tvtechnology.com/features/audio_notes/f-TC-metadta-8.21.02.shtml.

Painter, T., et al., "Perceptual Coding of Digital Audio", Proceedings of the IEEE, New York, NY, vol. 88, No. 4, Apr. 2000, pp. 451-513.

Swanson, M. D., et al., "Multiresolution Video Watermarking Using Perceptual Models and Scene Segmentation," Proceedings of the International Conference on Image Processing, Santa Barbara, Ca, Oct. 26-29, 1997, Los Alamitos, CA IEEE Computer Society, US, vol. 2, Oct. 1997, pp. 558-561.

Todd, et al., "AC-3: Flexible Perceptual Coding for Audio Transmission and Storage," 96th Convention of the Audio Engineering Society, Preprint 3796, Feb. 1994, pp. 1-16.

Smith, et al., "Tandem-Free VoIP Conferencing: A Bridge to Next-Generation Networks," IEEE Communications Magazine, May 2003, pp. 136-145.

Riedmiller Jeffrey C., "Solving TV Loudness Problems Can You 'Accurately' Hear the Difference," Communications Technology, Feb. 2004.

Moore, B. C. J., et al., "A Model for the Prediction of Thresholds, Loudness and Partial Loudness," Journal of the Audio Engineering Society, New York, NY vol. 45, No. 4, Apr. 1, 1997, pp. 224-240.

Glasberg, B. R., et al., "A Model of Loudness Applicable to Time-Varying Sounds," Audio Engineering Society, New York, NY, vol. 50, No. 5, May 2002, pp. 331-342.

Hauenstein, M., "A Computationally Efficient Algorithm for Calculating Loudness Patterns of Narrowband Speech," Acoustics, Speech and Signal Processing, 1997, IEEE International Conference, Munich, Germany, Apr. 21-24, 1997, Los Alamitos, CA USE, IEEE Comput. Soc. US Apr. 21, 1997, pp. 1311-1314.

Trappe, W., et al., "Key Distribution fro Secure Multimedia Multicasts via Data Embedding," 2001 IEEE International Conferences on Acoustics, Speech and Signal Processing Proceedings, Salt Lake City UT, May 7-11, 2001 IEEE International Conference on Acoustics, Speech and Signal Processing, New York, NY, IEEE, US, vol. 1 of 6, pp. 1449-1452.

Foti, Frank, "DTV Audio Processing: Exploring the New Frontier," OMNIA, Nov. 1998, pp. 1-3.

Faller, C., "Coding of Spatial Audio Compatible with Different Playback Formats," Audio Engineering Society Convention Paper, New York, NY, Oct. 28-31, 2004, pp. 1-12.

Herre, J., et al., "MP3 Surround: Efficient and Compatible Coding of Multi-Channel Audio," Audio Engineering Society Convention Preprint, May 8-11, 2004, pp. 1-14.

Fielder, L.D., et al., "Introduction to Dolby Digital Plus, an Enhancement to the Dolby Digital Coding System," Preprints of papers presented at the AES Convention, Oct. 28, 2004, pp. 1-30.

Herre, J., et al., "Spatial Audio Coding: Next-Generation Efficient and Compatible Coding of Multi-Channel Audio," AES Convention paper 6186, Oct. 28-31, 2004, pp. 1-13.

Faller, Christof, "Parametric Coding of Spatial Audio—Thesis No. 3062," These Presentee a la Faculte Informatique et Communications Section des Systemes de Communication Ecole Polytechnique Federale de Lausanne pour L'Obtention du Grade de Docteur es Sciences, 2004, page complete, XP-002343263.

Herre, J., et al., "The Reference Model Architecture for MPEG Spatial Audio Coding," AES Convention paper, New York, NY, May 28-31, 2005, pp. 1-13.

Schuijers, e., et al., "Low Complexity Parametric Stereo Coding," Preprints of papers presented at the AES Convention No. 6073, May 8, 2004, pp. 1-11.

U.S. Appl. No. 10/474,387, filed Oct. 7, 2003, Brett Graham Crockett—Jul. 6, 2007 Office Action.

U.S. Appl. No. 10/474,387, filed Oct. 7, 2003, Brett Graham Crockett—Sep. 20, 2007 Response to Office Action.

PCT/US02/04317, filed Feb. 12, 2002—International Search Report dated Oct. 15, 2002.

Laroche, Jean, "Autocorrelation Method for High-Quality Time/Pitch-Scaling," Telecom Paris, Departement Signal, 75634 Paris Cedex 13. France, email: laroche@sig.enst.fr.

Australian Patent Office—Feb. 19, 2007—Examiner's first report on application No. 2002248431.

Chinese Patent Office—Apr. 22, 2005—Notification of First Office Action for Application No. 02808144.7.

Chinese Patent Office—Dec. 9, 2005—Notification of Second Office Action for Application No. 02808144.7.

Malaysian Patent Office—Apr. 7, 2006—Substantive Examination Adverse Report—Section 30(1) / 30(2)) for Application No. PI 20021371.

U.S. Appl. No. 10/476,347, filed Oct. 28, 2003, Brett Graham Crockett—Feb. 12, 2007 Office Action.

U.S. Appl. No. 10/476,347, filed Oct. 28, 2003, Brett Graham Crockett—May 14, 2007 Response to Office Action.

PCT/US02/12957, filed Apr. 25, 2002—International Search Report dated Aug. 12, 2002.

Vafin, et al., "Modifying Transients for Efficient Coding of Audio," IEEE, pp. 3285-3288, Apr. 2001.

Vafin, et al., "Improved Modeling of Audio Signals by Modifying Transient Locations," pp. W2001-W2001-4, Oct. 21-24, 2001, New Paltz, New York.

Australian Patent Office—Feb. 26, 2007—Examiner's first report on application No. 2002307533.

Chinese Patent Office—May 13, 2005—Notification of First Office Action for Application No. 02809542.1.

Chinese Patent Office—Feb. 17, 2006 Notification of Second Office Action for Application No. 02809542.1.

European Patent Office—Dec. 19, 2005—Communication Pursuant to Article 96(2) for EP Application No. 02 769 666.5-2218.

Indian Patent Office—Jan. 3, 2007—First Examination Report for Application No. 1308/KOLNP/2003-J.

U.S. Appl. No. 10/478,397, filed Nov. 20, 2003, Brett G. Crockett—Feb. 27, 2007 Office Action.

U.S. Appl. No. 10/478,397, filed Nov. 20, 2003, Brett G. Crockett—May 29, 2007 Response to Office Action.

PCT/US02/05329, filed Feb. 22, 2002—International Search Report dated Oct. 7, 2002.
Edmonds, et al., "Automatic Feature Extraction from Spectrograms for Acoustic-Phonetic Analysis," pp. 701-704, Lutchi Research Center, Loughborough University of Technology, Loughborough, U.K.
Chinese Patent Office—Mar. 10, 2006—Notification of the First Office Action for Application No. 02810670.9.
U.S. Appl. No. 10/478,398, filed Nov. 20, 2003, Brett G. Crockett—Feb. 27, 2007 Office Action.
U.S. Appl. No. 10/478,398, filed Nov. 20, 2003, Brett G. Crockett—May 29, 2007 Response to Office Action.
U.S. Appl. No. 10/478,398, filed Nov. 20, 2003, Brett G. Crockett—Oct. 19, 2007 Request for Continued Examination with attached IDS.
U.S. Appl. No. 10/478,398, filed Nov. 20, 2003, Brett G. Crockett—Jan. 30, 2008 Office Action.
PCT/US02/05806, filed Feb. 25, 2002—International Search Report dated Oct. 7, 2002.
Chinese Patent Office—Nov. 5, 2004—Notification of First Office Action for Application No. 02810672.5.
Chinese Patent Office—Aug. 26, 2005—Notification of Second Office Action for Application No. 02810672.5.
European Patent Office—Aug. 10, 2004—Communication pursuant to Article 96(2) EPC for Application No. 02 707896.3-1247.
European Patent Office—Dec. 16, 2005—Communication pursuant to Article 96(2) EPC for Application No. 02 707 896.3-1247.
Indian Patent Office—Oct. 10, 2006—First Examination Report for Application No. 01490/KOLNP/2003.
Indian Patent Office—May 29, 2007—Letter for Application No. 01490/KOLNP/2003.
Indian Patent Office—Aug. 10, 2007—Letter for Application No. 01490/KOLNP/2003.
Japanese Patent Office—Partial Translation of Office Action.
U.S. Appl. No. 10/478,538, filed Nov. 20, 2003, Brett G. Crockett—Aug. 24, 2006 Office Action.
U.S. Appl. No. 10/478,538, filed Nov. 20, 2003, Brett G. Crockett—Nov. 24, 2006 Response to Office Action.
U.S. Appl. No. 10/478,538, filed Nov. 20, 2003, Brett G. Crockett—Feb. 23, 2007 Office Action.
U.S. Appl. No. 10/478,538, filed Nov. 20, 2003, Brett G. Crockett—Jun. 25, 2007 Response to Office Action.
U.S. Appl. No. 10/478,538, filed Nov. 20, 2003, Brett G. Crockett—Sep. 10, 2007 Office Action.
U.S. Appl. No. 10/478,538, filed Nov. 20, 2003, Brett G Crockett—Jan. 9, 2008—Response to Office Action.
PCT/US02/05999, filed Feb. 26, 2002—International Search Report dated Oct. 7, 2002.
Fishbach, Alon, Primary Segmentation of Auditory Scenes, IEEE, pp. 113-117, 1994.
Australian Patent Office—Mar. 9, 2007—Examiner's first report on application No. 2002252143.
Chinese Patent Office—Dec. 31, 2004—Notification of the First Office Action for Application No. 02810671.7.
Chinese Patent Office—Jul. 15, 2005—Notification of Second Office Action for Application No. 02810671.7.
Chinese Patent Office—Apr. 28, 2006—Notification of Third Office Action for Application No. 02810671.7.
Chinese Patent Office—Feb. 15, 2008—Notification of Fourth Office Action for Application No. 02810671.7.
Indian Patent Office—Nov. 23, 2006 First Examination Report for Application No. 01487/KOLNP/2003-G.
Indian Patent Office—Jul. 30, 2007 (Aug. 2, 2007) Letter from the Indian Patent Office for Application No. 01487/KOLNP/2003-G.
U.S. Appl. No. 11/999,159, filed Aug. 31, 2006, Mark Franklin Davis—Pending claims in application.
PCT/US2005/006359, filed Feb. 28, 2005—International Search Report and Written Opinion dated Jun. 6, 2005.
ATSC Standard: Digital Audio Compression (AC-3), Revision A, Doc A/52A, ATSC Standard, Aug. 20, 2001, pp. 1-140.
Schuijers, E., et al.; "Advances in Parametric Coding for High-Quality Audio," Preprints of Papers Presented at the AES Convention, Mar. 22, 2003, pp. 1-11, Amsterdam, The Netherlands.
European Patent Office—Sep. 28, 2007—Examination Report for Application No. 05 724 000.4-2225.
European Patent Office—Jan. 26, 2007—Communication pursuant to Article 96(2) EPC for Application No. 05 724 000.4-2218.
SG 200605858-0 Singapore Patent Office Written Opinion dated Oct. 17, 2007 based on PCT Application filed Feb. 28, 2005.
U.S. Appl. No. 10/911,404, filed Aug. 3, 2004, Michael John Smithers—Oct. 5, 2006 Office Action.
U.S. Appl. No. 10/911,404, filed Aug. 3, 2004, Michael John Smithers—Jan. 5, 2007 Response to Office Action.
U.S. Appl. No. 10/911,404, filed Aug. 3, 2004, Michael John Smithers—Mar. 28, 2007 Office Action.
U.S. Appl. No. 10/911,404, filed Aug. 3, 2004, Michael John Smithers—Jun. 28, 2007 RCE and Response to Office Action.
U.S. Appl. No. 10/911,404, filed Aug. 3, 2004, Michael John Smithers—Aug. 10, 2007 Office Action.
U.S. Appl. No. 10/911,404, filed Aug. 3, 2004, Michael John Smithers—Dec. 7, 2007 Response to Office Action.
PCT/US2005/024630, filed Jul. 13, 2005—International Search Report and Written Opinion dated Dec. 1, 2005.
U.S. Appl. No. 11/999,159 filed Dec. 3, 2007, Alan Jeffrey Seefeldt, et al.—Pending claims in application.
PCT/US2006/020882, filed May 26, 2006—International Search Report and Written Opinion dated Feb. 20, 2007.
Faller, Christof, "Coding of Spatial Audio Compatible with Different Playback Formats," Audio Engineering Society Convention Paper, presented at the 117$^{th}$ Convention, pp. 1-12, Oct. 28-31, 2004, San Francisco, CA.
Herre, et al., "MP3 Surround: Efficient and Compatible Coding of Multi-Channel Audio," Audio Engineering Society Convention Paper, presented at the 116$^{th}$ Convention, pp. 1-14, May 8-11, 2004, Berlin, Germany.
Fielder, et al., "Introduction to Dolby Digital Plus, an Enhancement to the Dolby Digital Coding System," Audio Engineering Society Convention Paper, presented at the 117$^{th}$ Convention, pp. 1-29, Oct. 28-31, 2004, San Francisco, CA.
Herre, et al., "Spatial Audio Coding: Next-Generation Efficient and Compatible Coding of Multi-Channel Audio," Audio Engineering Society Convention Paper, presented at the 117$^{th}$ Convention, pp. 1-13, Oct. 28-31, 2004, San Francisco, CA.
Faller, Christof, "Parametric Coding of Spatial Audio," These No. 3062, pp. 1-164, (2004) Lausanne, EPFL.
Herre, et al., "The Reference Model Architecture for MPEG Spatial Audio Coding," Audio Engineering Society Convention Paper, presented at the 118$^{th}$ Convention, pp. 1-13, May 28-31, 2005, Barcelona, Spain.
Schuijers, et al., "Low Complexity Parametric Stereo Coding," Audio Engineering Society Convention Paper, presented at the 116$^{th}$ Convention, pp. 1-11, May 8-11, 2004, Berlin, Germany.
PCT/US2006/028874, filed Jul. 24, 2006—Alan Jeffrey Seefeldt and Mark Stuart Vinton—Pending claims in application.
PCT/US2007/008313, filed Mar. 30, 2007—International Search Report and Written Opinion dated Sep. 21, 2007.
Blesser, B., "An Ultraminiature Console Compression System with Maximum User Flexibility," presented Oct. 8, 1971 at the 41$^{st}$ Convention of the Audio Engineering Society, New York, AES May 1972 vol. 20, No. 4, pp. 297-302.
Hoeg, W., et al., "Dynamic Range Control (DRC) and Music/Speech Control (MSC) Programme-Associated Data Services for DAB," EBU Review—Technical, European Broadcasting Union. Brussels, BE, No. 261, Sep. 21, 1994, pp. 56-70.

* cited by examiner

CHANNEL RECONFIGURATION WITH SIDE INFORMATION

CROSS-REFERENCES TO RELATED APPLICATIONS AND PATENTS

The present application is related to U.S. Non-Provisional patent application Ser. No. 10/474,387, entitled "High Quality Time-Scaling and Pitch-Scaling of Audio Signals," by Brett Graham Crockett, filed Oct. 7, 2003, published as US 2004/0122662 on Jun. 24, 2004. The PCT counterpart application was published as WO 02/084645 A2 on Oct. 24, 2002.

The present application is also related to U.S. Non-Provisional patent application Ser. No. 10/476,347, entitled "Improving Transient Performance of Low Bit Rate Audio Coding Systems by Reducing Pre-Noise," by Brett Graham Crockett, filed Oct. 28, 2003, published as US 2004/0133423 on Jul. 8, 2004, now U.S. Pat. No. 7,313,519. The PCT counterpart application was published as WO 02/093560 on Nov. 21, 2002.

The present application is also related to U.S. Non-Provisional patent application Ser. No. 10/478,397, entitled "Comparing Audio Using Characterizations Based on Auditory Events," by Brett Graham Crockett and Michael John Smithers, filed Nov. 20, 2003, published as 2004/0172240 on Sep. 2, 2004, now U.S. Pat. No. 7,283,954. The PCT counterpart application was published as WO 02/097790 on Dec. 5, 2002.

The present application is also related to U.S. Non-Provisional patent application Ser. No. 10/474,398, entitled "Method for Time Aligning Audio Signals using Characterizations Based on Auditory Events," by Brett Graham Crockett and Michael John Smithers, filed Nov. 20, 2003, published as US 2004-0148159 on Jul. 29, 2004. The PCT counterpart application was published as WO 02/097791 on Dec. 5, 2002.

The present application is also related to U.S. Non-Provisional patent application Ser. No. 10/478,538, entitled "Segmenting Audio Signals into Auditory Events," by Brett Graham Crockett, filed Nov. 20, 2003, published as US 2004/0165730 on Aug. 26, 2004. The PCT counterpart application was published as WO 02/097792 on Dec. 5, 2002.

The present application is also related to U.S. Non-Provisional patent application Ser. No. 10/591,374, entitled "Multichannel Audio Coding," by Mark Franklin Davis, filed Aug. 31, 2006, published as US/2007/0140499 on Jun. 21, 2007. The PCT counterpart application was published as WO 05/086139 on Sep. 15, 2005.

The present application is also related to U.S. Non-Provisional patent application Ser. No. 10/911,404, entitled "Method for Combining Audio Signals Using Auditory Scene Analysis," by Michael John Smithers, filed Aug. 3, 2004, published as US/2006/0029239 on Feb. 9, 2006. The PCT counterpart application was published as WO 2006/019719 on Feb. 23, 2006.

The present application is also related to PCT Application (designating the U.S.) S.N. PCT/2006/028874, entitled "Controlling Spatial Audio Coding Parameters as a Function of Auditory Events," by Alan Jeffrey Seefeldt and Mark Stuart Vinton, filed Jul. 24, 2006, The PCT counterpart application was published as WO 07/016107 on Feb. 8, 2007.

The present application is also related to PCT Application (designating the U.S.), S.N. PCT/2007/008313, entitled "Audio Gain Control Using Specific-Loudness-Based Auditory Event Detection," by Brett Graham Crockett and Alan Jeffrey Seefeldt, filed Mar. 30, 2007, The PCT counterpart application was published as WO 2007/127023 on Nov. 8, 2007.

BACKGROUND OF THE INVENTION

With the widespread adoption of DVD players, the utilization of multichannel (greater than two channels) audio playback systems in the home has become commonplace. In addition, multichannel audio systems are becoming more prevalent in the automobile and next generation satellite and terrestrial digital radio systems are eager to deliver multichannel content to a growing number of multichannel playback environments. In many cases, however, would-be providers of multichannel content face a dearth of such material. For example, most popular music still exists as two-channel stereophonic ("stereo") tracks only. As such, there is a demand to "upmix" such "legacy" content that exists in either monophonic ("mono") or stereo format into a multichannel format.

Prior art solutions exist for achieving this transformation. For example, Dolby Pro Logic II can take an original stereo recording and generate a multichannel upmix based on steering information derived from the stereo recording itself. "Dolby", "Pro Logic", and "Pro Logic II" are trademarks of Dolby Laboratories Licensing Corporation. In order to deliver such an upmix to a consumer, a content provider may apply an upmixing solution to the legacy content during production and then transmit the resulting multichannel signal to a consumer through some suitable multichannel delivery format such as Dolby Digital. "Dolby Digital" is a trademark of Dolby Laboratories Licensing Corporation. Alternatively, the unaltered legacy content may be delivered to a consumer who may then apply the upmixing process during playback. In the former case, the content provider has complete control over the manner in which the upmix is created, which, from the content provider's viewpoint, is desirable. In addition, processing constraints at the production side are generally far less than at the playback side and, therefore, the possibility of using more sophisticated upmixing techniques exists. However, upmixing at the production side has some drawbacks. First of all, transmission of a multichannel signal in comparison to a legacy signal is more expensive due to the increased number of audio channels. Also, if a consumer does not possess a multichannel playback system, the transmitted multichannel signal typically needs to be downmixed before playback. This downmixed signal, in general, is not identical to the original legacy content and may in many cases sound inferior to the original.

FIGS. 1 and 2 depict examples of prior art upmixing applied at the production and consumption ends, respectively, as just described. These examples assume that the original signal contains M=2 channels and that the upmixed signal contains N=6 channels. In the example of FIG. 1, upmixing is performed at the production end, whereas in FIG. 2, upmixing is performed at the consumption end. An upmixing as in FIG. 2, in which the upmixer receives only the audio signals upon which it is to perform an upmix is sometimes referred to as a "blind" upmix.

Referring to FIG. 1, in the Production portion 2 of an audio system, one or more audio signals constituting M-Channel Original Signals (in this and other figures herein, each audio signal may represent a channel, such as a left channel, a right channel, etc.) are applied to an upmix device or upmixing function ("Upmix") 4 that produces an increased number of audio signals constituting N-Channel Upmix Signals. The Upmix Signals are applied to a formatter device or formatting function ("Format") 6 that formats the N-Channel Upmix Signals into a form suitable for transmission or storage. The formatting may include data-compression encoding. The formatted signals are received by the Consumption portion 8 of the audio system in which a deformatting function or deformatter device ("Deformat") 10 restores the formatted signals to the N-Channel Upmix Signals (or an approximation of them). As discussed above, in some cases a downmixer device or downmixing function ("Downmix") 12 also downmixes the N-Channel Upmix signals to M-Channel Downmix Signals (or an approximation of them), where M<N.

Referring to FIG. 2, in the Production portion 14 of an audio system, one or more audio signals constituting M-Channel Original Signals are applied to a formatter device or formatting function ("Format") 6 that formats them into a form suitable for transmission or storage (in this and other figures, the same reference numeral is used for devices and functions that are essentially the same in different figures). The formatting may include data-compression encoding. The formatted signals are received by the Consumption portion 16 of the audio system in which a deformatter function or deformatting device ("Deformat") 10 restores the formatted signals to the M-Channel Original Signals (or an approximation of them). The M-Channel Original Signals may be provided as an output and they are also applied to an upmixer function or upmixing device ("Upmix") 18 that upmixes the M-Channel Original Signals to produce N-Channel Upmix Signals.

SUMMARY OF THE INVENTION

Aspects of the present invention provide alternatives to the arrangements of FIGS. 1 and 2. For example, according to certain aspects of the present invention, rather than upmixing the legacy content at either the production or consumption end, analysis of the legacy content by a process at, for example, an encoder may generate auxiliary, "side," or "sidechain" information that is sent along, in some manner, with the legacy content audio information to a further process at, for example, a decoder. The manner in which the side information is sent is not critical to the invention; many ways of sending side information are known, including, for example, embedding the side information in the audio information (e.g., hiding it) or by sending the side information separately (e.g., in its own bitstream or multiplexed with the audio information). "Encoder" and "decoder" in this context refer, respectively, to a device or process associated with production and a device or process associated with consumption—such devices and processes may or may not include data compression "encoding" and "decoding." Side information generated by an encoder may instruct the decoder how to upmix the legacy content. Thus, the decoder provides upmixing with the help of side information. Although control of the upmix technique may lie at the production end, the consumer may still receive unaltered legacy content that may be played back unaltered if a multichannel playback system is not available. In addition, significant processing power may be utilized at an encoder to analyze the legacy content and generate side information for a high quality upmix, allowing the decoder to employ significantly fewer processing resources because it only applies the side information rather than deriving it. Lastly, transmission cost of such upmix side information is typically very low.

Although the present invention and its various aspects may involve analog or digital signals, in practical applications most or all processing functions are likely to be performed in the digital domain on digital signal streams in which audio signals are represented by samples. Signal processing according to the present invention may be applied either to wideband signals or to each frequency band of a multiband processor, and depending on implementation, may be performed once per sample or once per set of samples, such as a block of samples when the digital audio is divided into blocks. A multiband embodiment may employ either a filter bank or a transform configuration. Thus, the examples of embodiments of the present invention shown and described in connection with FIGS. 3, 4A-4C, 5A-5C, and 6 may receive digital signals in the time domain (such as, for example, PCM signals) and apply them to a suitable time-to-frequency converter or conversion for processing in multiple frequency bands, which bands may be related to critical bands of the human ear. After processing, the signals may be converted back to the time-domain. In principle, either a filterbank or a transform may be employed to achieve time-to-frequency conversion and its inverse. Some detailed examples of embodiments of aspects of the invention described herein employ time-to-frequency transforms, namely the Short-time Discrete Fourier Transform (STDFT). It will be appreciated, however, that the invention in its various aspects is not limited to the use of any particular time-to-frequency converter or conversion process.

In accordance with one aspect of the present invention, a method for processing at least one audio signal or a modification of the at least one audio signal having the same number of channels as the at least one audio signal, each audio signal representing an audio channel comprises deriving instructions for channel reconfiguring the at least one audio signal or its modification, wherein the only audio information that the deriving receives is the at least one audio signal or its modification, and providing an output that includes (1) the at least one audio signal or its modification, and (2) the instructions for channel reconfiguring, but does not include any channel reconfiguration of the at least one audio signal or its modification when such a channel reconfiguration results from the instructions for channel reconfiguring. The at least one audio signal and its modification may each be two or more audio signals, in which case, the modified two or more signals may be a matrix-encoded modification, and, when decoded, as by a matrix decoder or an active matrix decoder, the modified two or more audio signals may provide an improved multichannel decoding with respect to a decoding of the unmodified two or more audio signals. The decoding is "improved" in the sense of any well-known performance characteristics of decoders such as matrix decoders, including, for example channel separation, spatial imaging, image stability, etc.

Whether or not the at least one audio signal and its modification are two or more audio signals, there are several alternatives for channel reconfiguring instructions. According to one alternative, the instructions are for upmixing the at least one audio signal or its modification such that, when upmixed in accordance with the instructions for upmixing, the resulting number of audio signals is greater than the number of audio signals comprising the at least one audio signal or its modification. According to other alternatives for channel reconfiguring instructions, the at least one audio signal and its modification are two or more audio signals. In a first of such other alternatives, the instructions are for downmixing the two or more audio signals such that, when downmixed in accordance with the instructions for downmixing, the resulting number of audio signals is less than the number of audio signals comprising the two or more audio signals. In a second of such other alternatives, the instructions are for reconfiguring the two or more audio signals such that, when reconfigured in accordance with the instructions for reconfiguring, the number of audio signals remains the same but one or more spatial locations at which such audio signals are intended to be reproduced are changed. The at least one audio signal or its modification in the output may be a data-compressed version of the at least one audio signal or its modification, respectively.

In any of the alternatives and whether or not data compression is employed, instructions may be derived without reference to any channel reconfiguration resulting from the instructions for channel reconfiguring. The at least one audio signal may be divided into frequency bands and the instructions for channel reconfiguring may be with respect to respective ones of such frequency bands. Other aspects of the invention include audio encoders practicing such methods.

According to another aspect of the invention, a method for processing at least one audio signal or a modification of the at least one audio signal having the same number of channels as the at least one audio signal, each audio signal representing an audio channel, comprises deriving instructions for channel reconfiguring the at least one audio signal or its modification, wherein the only audio information that the deriving receives is the at least one audio signal or its modification, providing an output that includes (1) the at least one audio signal or its modification, and (2) the instructions for channel reconfiguring but does not include any channel reconfiguration of the at least one audio signal or its modification when such a channel reconfiguration results from the instructions for channel reconfiguring, and receiving the output.

The method may further comprise channel reconfiguring the received at least one audio signal or its modification using the received instructions for channel reconfiguring. The at least one audio signal and its modification may each be two or more audio signals, in which case, the modified two or more signals may be a matrix-encoded modification, and, when decoded, as by a matrix decoder or an active matrix decoder, the modified two or more audio signals may provide an improved multichannel decoding with respect to the decoding of the unmodified two or more audio signals. "Improved" is used in the same sense as in the first aspect of the present invention, described above.

As in the first aspect of the invention, there are alternatives for channel reconfiguring instructions—for example, upmixing, downmixing, and reconfiguring such that the number of audio signals remains the same but one or more spatial locations at which such audio signals are intended to be reproduced are changed. As in the first aspect of the invention, the at least one audio signal or its modification in the output may be a data-compressed version of the at least one audio signal or its modification, in which case the receiving may include data decompressing the at least one audio signal or its modification. In any of the alternatives of this aspect of the present invention, whether or not data compression and decompression is employed, instructions may be derived without reference to any channel reconfiguration resulting from the instructions for channel reconfiguring.

As in the first aspect of the invention, the at least one audio signal or its modification may be divided into frequency bands, in which case the instructions for channel reconfiguring may be with respect to ones of such frequency bands. When the method further comprises reconfiguring the received at least one audio signal or its modification using the received instructions for channel reconfiguring, the method may yet further comprise providing an audio output and selecting as the audio output one of: (1) the at least one audio signal or its modification, or (2) the channel-reconfigured at least one audio signal.

Whether or not the method further comprises reconfiguring the received at least one audio signal or its modification using the received instructions for channel reconfiguring, the method may further comprise providing an audio output in response to the received at least one audio signal or its modification, in which case when the at least one audio signal or its modification in the audio output are two or more audio signals, the method may yet further comprise matrix decoding the two or more audio signals.

When the method further comprises reconfiguring the received at least one audio signal or its modification using the received instructions for channel reconfiguring, the method may yet further comprise providing an audio output.

Other aspects of the invention include an audio encoding and decoding system practicing such methods, an audio encoder and an audio decoder for use in a system practicing such methods, an audio encoder for use in a system practicing such methods, and an audio decoder for use in a system practicing such methods.

In accordance with another aspect of the invention, a method for processing at least one audio signal or a modification of the at least one audio signal having the same number of channels as said at least one audio signal, each audio signal representing an audio channel, comprises receiving at least one audio signal or its modification and instructions for channel reconfiguring the at least one audio signal or its modification but no channel reconfiguration of the at least one audio signal or its modification resulting from said instructions for channel reconfiguring, said instructions having been derived by an instruction derivation in which the only audio information received is said at least one audio signal or its modification, and channel reconfiguring the at least one audio signal or its modification using said instructions. The at least one audio signal and its modification may each be two or more audio signals, in which case, the modified two or more signals may be a matrix-encoded modification, and, when decoded, as by a matrix decoder or an active matrix decoder, the modified two or more audio signals may provide an improved multichannel decoding with respect to the decoding of the unmodified two or more audio signals. "Improved" is used in the same sense as in the other aspects of the present invention, described above.

As in other aspects of the invention, there are alternatives for channel reconfiguring instructions—for example, upmixing, downmixing, and reconfiguring such that the number of audio signals remains the same but one or more spatial locations at which such audio signals are intended to be reproduced are changed.

As in the other aspects of the invention, the at least one audio signal or its modification in the output may be a data-compressed version of the at least one audio signal or its modification, in which case the receiving may include data decompressing the at least one audio signal or its modification. In any of the alternatives of this aspect of the present invention, whether or not data compression and decompression is employed, instructions may be derived without reference to any channel reconfiguration resulting from the instructions for channel reconfiguring. As in the other aspects of the invention, the at least one audio signal or its modification may be divided into frequency bands, in which case the instructions for channel reconfiguring may be with respect to ones of such frequency bands. According to one alternative, this aspect of the invention may further comprise providing an audio output, and selecting as the audio output one of: (1) the at least one audio signal or its modification, or (2) the channel reconfigured at least one audio signal. According to another alternative, this aspect of the invention may further comprise providing an audio output in response to the received at least one audio signal or its modification, in which case the at least one audio signal and its modification may each be two or more audio signals and the two or more audio signals are matrix decoded. According to yet another alternative, this aspect of the invention may further comprise providing an audio output in response to the received channel-reconfigured at least one audio signal. Other aspects of the invention include an audio decoder practicing any of such methods.

In accordance with yet another aspect of the present invention, a method for processing at least two audio signals or a modification of the at least two audio signals having the same number of channels as said at least one audio signal, each audio signal representing an audio channel, comprises receiving said at least two audio signals and instructions for channel reconfiguring the at least two audio signals but no channel reconfiguration of the at least two audio signals resulting from said instructions for channel reconfiguring, said instructions having been derived by a an instruction derivation in which the only audio information received is said at least two audio signals, and matrix decoding the two or more audio signals. The matrix decoding may be with or without reference to the received instructions. When decoded, the modified two or more audio signals may provide an improved multichannel decoding with respect to the decoding of the unmodified two or more audio signals. The modified two or more signals may be a matrix-encoded modification, and, when decoded, as by a matrix decoder or an active matrix decoder, the modified two or more audio signals may provide an improved multichannel decoding with respect to the decoding of the unmodified two or more audio signals. "Improved" is used in the same sense as in other aspects of the present invention, described above. Other aspects of the invention include an audio decoder practicing any of such methods.

In yet further aspects of the invention, two or more audio signals, each audio signal representing an audio channel, are modified so that the modified signals may provide an improved multichannel decoding, with respect to a decoding of the unmodified signals, when decoded by a matrix decoder. This may be accomplished by modifying one or more differences in intrinsic signal characteristics between or among the audio signals. Such intrinsic signal characteristics may include one or both of amplitude and phase. Modifying one or more differences in intrinsic signal characteristics between or among ones of the audio signals may include upmixing the unmodified signals to a larger number of signals, and downmixing the upmixed signals using a matrix encoder. Alternatively, modifying one or more differences in intrinsic signal characteristics between or among the audio signals may also include increasing or decreasing the cross correlation between or among ones of the audio signals. The cross correlation between or among the audio signals may be variously increased and/or decreased in one or more frequency bands.

Other aspects of the invention include (1) apparatus adapted to perform the methods of any one of herein described methods, (2) a computer program, stored on a computer-readable medium, for causing a computer to perform any one of the herein described methods, (3) a bitstream produced by ones of the herein described methods, and a (4) bitstream produced by apparatus adapted to perform the methods of ones of the herein described methods.

DESCRIPTION OF THE INVENTION

Figure 1:
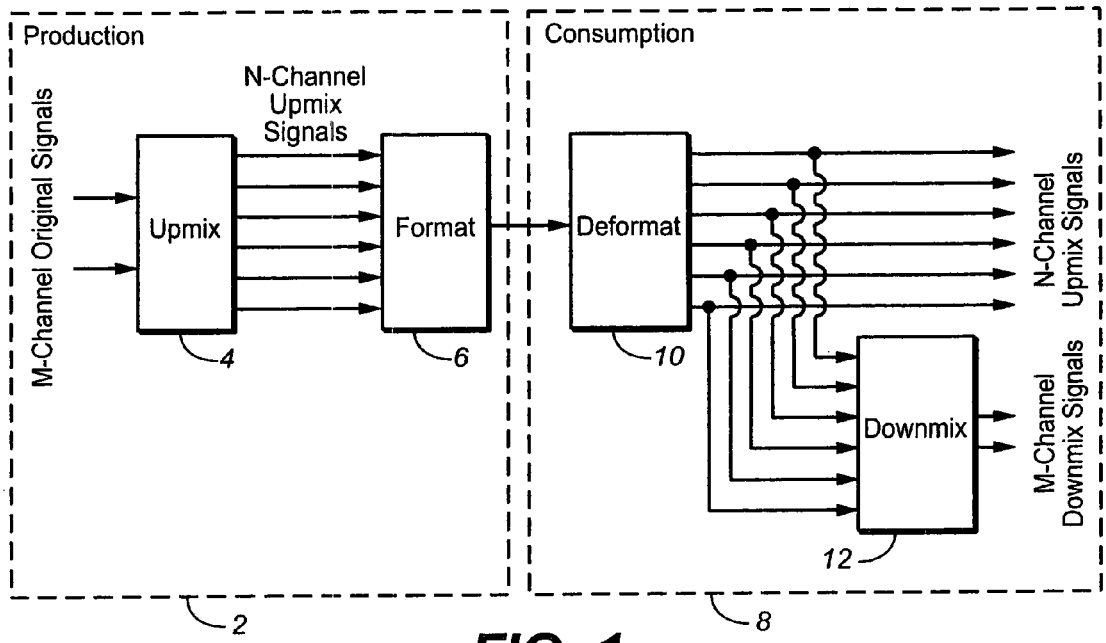
FIG. 1 (PRIOR ART)
FIG. 1 is a functional schematic block diagram of a prior art arrangement for upmixing having a production portion and a consumption portion in which the upmixing is performed in the consumption portion.
Figure 2:
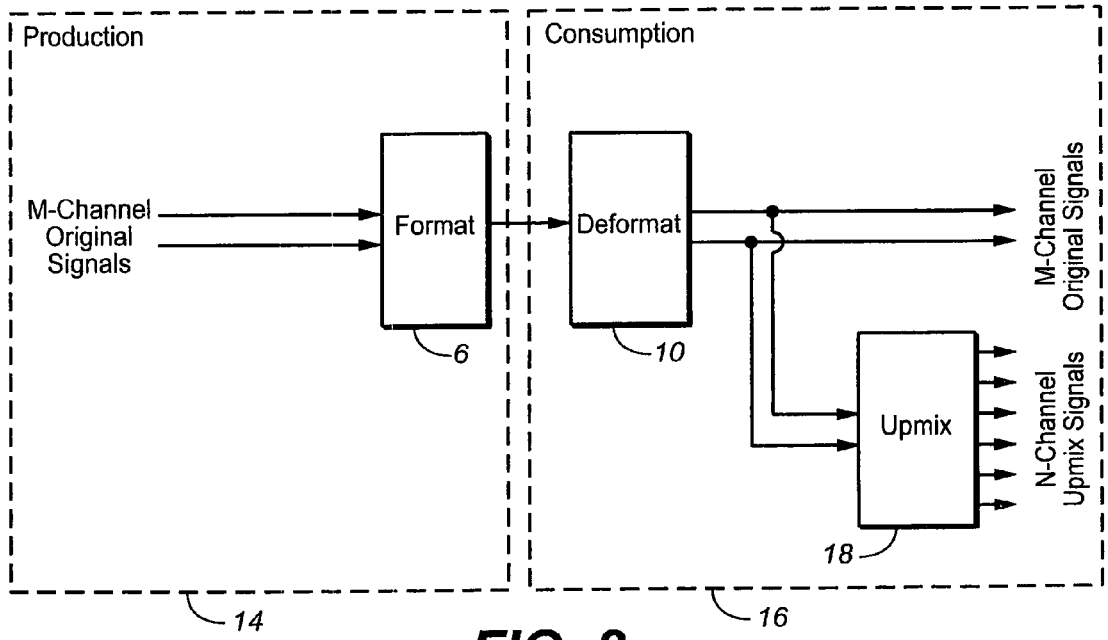
FIG. 2 (PRIOR ART)
FIG. 2 is a functional schematic block diagram of a prior art arrangement for upmixing having a production portion and a consumption portion in which the upmixing is performed in the production portion.
Figure 3:
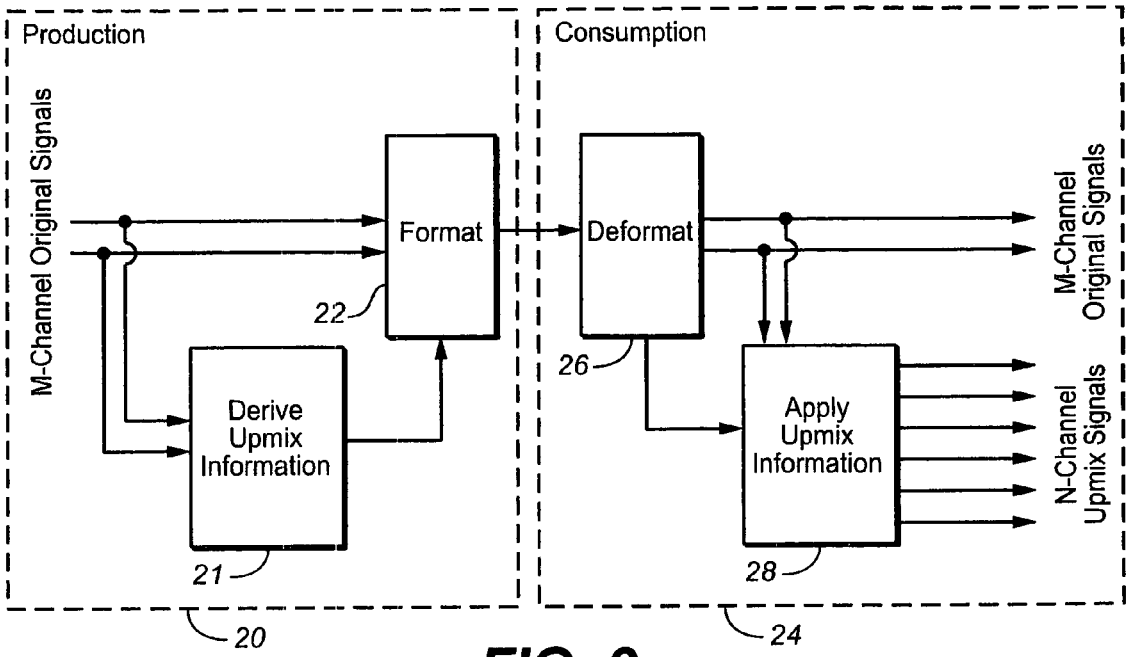
FIG. 3 is a functional schematic block diagram of an example of an upmixing embodiment of aspects of the present invention in which instructions for upmixing are derived in a production portion and the instructions are applied in a consumption portion.

FIG. 3 depicts an example of aspects of the invention in an upmixing arrangement. In the Production 20 portion of the arrangement, M-Channel Original Signals (e.g., legacy audio signals) are applied to a device or function that derives one or more sets of upmix side information ("Derive Upmix Information") 21 and to a formatter device or formatting function ("Format") 22. Alternatively, the M-Channel Original Signals of FIG. 3 may be a modified version of the legacy audio signals, as described below. Format 22 may include a multiplexer or multiplexing function, for example, that formats or arranges the M-Channel Original Signals, the upmix side information, and other data into, for example, a serial bitstream or parallel bitstreams. Whether the output bitstream of the Production 20 portion of the arrangement is serial or parallel is not critical to the invention. Format 22 may also include a suitable data-compression encoder or encoding function such as a lossy, lossless, or a combination lossy and lossless encoder or encoding function. Whether the output bitstream or bitstreams are encoded is also not critical to the invention. The output bitstream or bitstreams are transmitted or stored in any suitable manner.

In the Consumption 24 portion of the arrangement of the example of FIG. 3, the output bitstream or bitstreams are received and a deformatter or deformatting function ("Deformat") 26 undoes the action of the Format 22 to provide the M-Channel Original Signals (or an approximation of them) and the upmix information. Deformat 26 may include, as may be necessary, a suitable data-compression decoder or decoding function. The upmix information and the M-Channel Original Signals (or an approximation of them) are applied to an upmixer device or upmixing function ("Upmix") 28 that upmixes the M-Channel Original Signals (or an approximation of them) in accordance with the upmix instructions to provide N-Channel Upmix Signals. There may be multiple sets of upmix instructions, each providing, for example, an upmixing to a different number of channels. If there are multiple sets of upmix instructions, one or more sets are chosen (such choice may be fixed in the Consumption portion of the arrangement or it may be selectable in some manner). The M-Channel Original Signals and the N-Channel Upmix Signals are potential outputs of the Consumption 24 portion of the arrangement. Either or both may be provided as outputs (as shown) or one or the other may be selected, the selection being implemented by a selector or selection function (not shown) under automatic control or manual control, for example, by a user or consumer. Although FIG. 3 shows symbolically that M=2 and N=6, it will be understood that M and N are not limited thereto.

In one example of a practical application of aspects of the present invention, two audio signals, representing respective stereo sound channels are received by a device or process and it is desired to derive instructions suitable for use in upmixing those two audio signals to what is typically referred to as "5.1" channels (actually, six channels, in which one channel is a low-frequency effects channel requiring very little data). The original two audio signals along with the upmixing instructions may then be sent to an upmixer or upmixing process that applies the upmixing instructions to the two audio signals in order to provide the desired 5.1 channels (an upmix employing side information). However, in some cases the original two audio signals and related upmixing instructions may be received by a device or process that may be incapable of using the upmixing instructions but, nevertheless, it may be adapted to performing an upmix of the received two audio signals, an upmix that is often referred to as a "blind" upmix, as mentioned above. Such blind upmixes may be provided, for example, by an active matrix decoder such as a Pro Logic, Pro Logic II, or Pro Logic IIx decoder (Pro Logic, Pro Logic II, and Pro Logic IIx are trademarks of Dolby Laboratories Licensing Corporation). Other active matrix decoders may be employed. Such active matrix blind upmixers depend on and operate in response to intrinsic signal characteristics (such as amplitude and/or phase relationships among signals applied to it) to perform an upmix. A blind upmix may or may not result in the same number of channels as would have been provided by a device or function adapted to use the upmix instructions (e.g., in this example, a blind upmix might not result in 5.1 channels).

A "blind" upmix performed by an active matrix decoder is best when its inputs were pre-encoded by a device or function compatible with the active matrix decoder such as by a matrix encoder, particularly a matrix encoder complementary to the decoder. In that case, the input signals have intrinsic amplitude and phase relationships that are used by the active matrix decoder. A "blind" upmix of signals that were not pre-encoded by a compatible device, such signals not having useful intrinsic signal characteristics (or having only minimally useful intrinsic signal characteristics), such as amplitude or phase relationships, is best performed by what may be termed an "artistic" upmixer, typically a computationally complex upmixer, as discussed further below.

Although aspects of the invention may be advantageously used for upmixing, they apply to the more general case in which at least one audio signal designed for a particular "channel configuration" is altered for playback over one or more alternate channel configurations. An encoder, for example, generates side information that instructs a decoder, for example, how to alter the original signal, if desired, for one or more alternate channel configurations. "Channel configuration" in this context includes, for example, not only the number of playback audio signals relative to the original audio signals but also the spatial locations at which playback audio signals are intended to be reproduced with respect to the spatial locations of the original audio signals. Thus, a channel "reconfiguration" may include, for example, "upmixing" in which one or more channels are mapped in some manner to a larger number of channels, "downmixing" in which two or more channels are mapped in some manner to a smaller number of channels, spatial location reconfiguration in which that locations at which channels are intended to be reproduced or directions with which channels are associated are changed or remapped in some manner, and conversion from binaural to loudspeaker format (by crosstalk cancellation or processing with a crosstalk canceller) or from loudspeaker format to binaural (by "binauralization" or processing by a loudspeaker format to binaural converter, a "binauralizer"). Thus, in the context of channel reconfiguration according to aspects of the present invention, the number of channels in the original signal may be less than, greater than, or equal to the number of channels in any of the resulting alternate channel configurations.

An example of a spatial location configuration is a conversion from a quadraphonic configuration (a "square" layout with left front, right front, left rear and right rear) to a conventional motion picture configuration (a "diamond" layout, with left front, center front, right front and surround).

An example of a non-upmixing "reconfiguration" application of aspects of the present invention is described in U.S. patent application Ser. No. 10/911,404 of Michael John Smithers, filed Aug. 3, 2004, entitled "Method for Combining Audio Signals Using Auditory Scene Analysis." Smithers describes a technique for dynamically downmixing signals in a way that avoids common comb filtering and phase cancellation effects associated with a static downmix. For example, an original signal may consist of left, center, and right channels, but in many playback environments a center channel is not available. In this case, the center channel signal needs to be mixed into the left and right for playback in stereo. The method disclosed by Smithers dynamically measures during playback an average overall delay between the center channel and the left and right channels. A corresponding compensating delay is then applied to the center channel before it is mixed with the left and right channels in order to avoid comb filtering. In addition, a power compensation is computed for and applied to each critical band of each downmixed channel in order to remove other phase cancellation effects. Rather than compute such delay and power compensation values during playback, the current invention allows for their generation as side information at an encoder, and then the values may be optionally applied at a decoder if playback over a conventional stereo configuration is required.

Figure 4A:
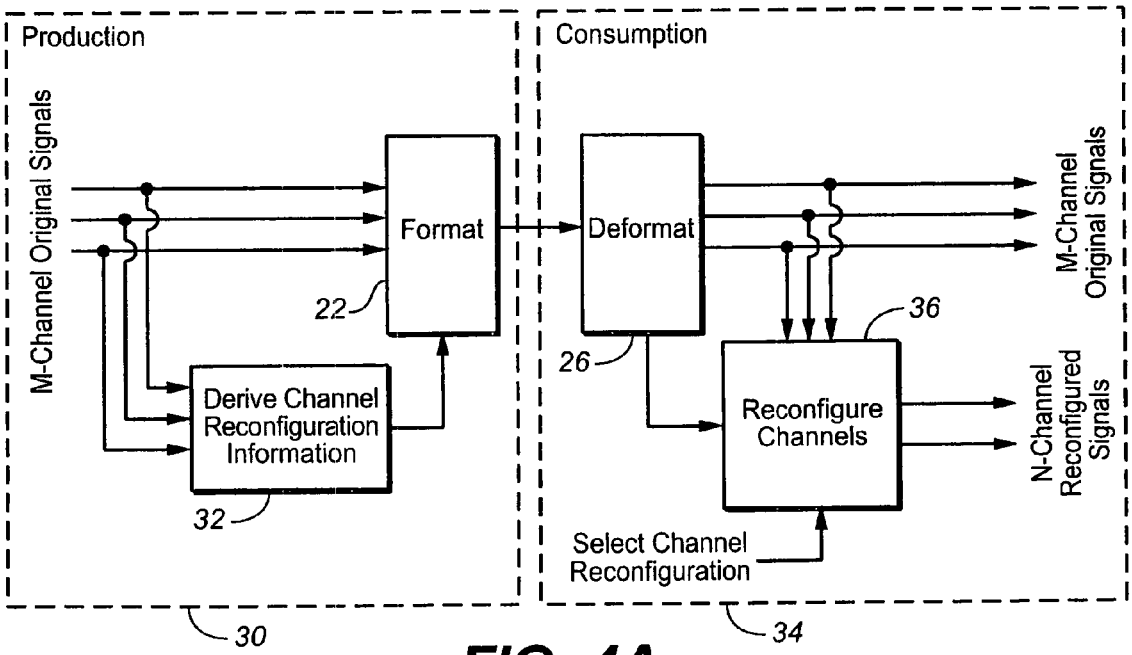
FIG. 4A is a functional schematic block diagram of a generalized channel reconfiguration embodiment of aspects of the present invention in which instructions for channel reconfiguration are derived in a production portion and the instructions are applied in a consumption portion.

FIG. 4A depicts an example of aspects of the invention in a generalized channel reconfiguration arrangement. In the Production 30 portion of the arrangement, M-Channel Original Signals (legacy audio signals) are applied to a device or function that derives one or more sets of channel reconfiguration side information ("Derive Channel Reconfiguration Information") 32 and to a formatter device or formatting function ("Format") 22 (described in connection with the example of FIG. 3). The M-Channel Original Signals of FIG. 4A may be a modified version of the legacy audio signals, as described below. The output bitstream or bitstreams are transmitted or stored in any suitable manner.

In the Consumption portion 34 of the arrangement, the output bitstream or bitstreams are received and a deformatter device or deformatting function ("Deformat") 26 (described in connection with FIG. 3) undoes the action of the Format 22 to provide the M-Channel Original Signals (or an approximation of them) and the channel reconfiguration information. The channel reconfiguration information and the M-Channel Original Signals (or an approximation of them) are applied to a device or function ("Reconfigure Channels") 36 that channel reconfigures the M-Channel Original Signals (or an approximation of them) in accordance with the instructions to provide N-Channel Reconfigured Signals. As in the FIG. 3 example, if there are multiple sets of instructions, one or more sets are chosen ("Select Channel Reconfiguration") (such choice may be fixed in the Consumption portion of the arrangement or it may be selectable in some manner). As in the FIG. 3 example, the M-Channel Original Signals and the N-Channel Reconfigured Signals are potential outputs of the Consumption portion 34 of the arrangement. Either or both may be provided as outputs (as shown) or one or the other may be selected, the selection being implemented by a selector or selection function (not shown) under automatic or manual control, for example, by a user or consumer. Although FIG. 4A shows symbolically that M=3 and N=2, it will be understood that M and N are not limited thereto. As noted above, the "channel reconfiguration" may include, for example, "upmixing" in which one or more channels are mapped in some manner to a larger number of channels, "downmixing" in which two or more channels are mapped in some manner to a smaller number of channels, spatial location reconfiguration in which that locations at which channels are intended to be reproduced are remapped in some manner, and conversion from binaural to loudspeaker format (by crosstalk cancellation or processing with a crosstalk canceller) or from loudspeaker format to binaural (by "binauralization" or processing by a loudspeaker format to binaural converter, a "binauralizer"). In the case of binauralization, the channel reconfiguration may include (1) an upmixing to multiple virtual channels and/or (2) a virtual spatial location reconfiguration rendered as a two-channel stereophonic binaural signal Virtual upmixing and virtual loudspeaker positioning are well known in the art since at least as early as the nineteen-sixties (see e.g., Atal et al, "Apparent Sound Source Translator," U.S. Pat. No. 3,236,949 (Feb. 26, 1966) and Bauer, "Stereophonic to Binaural Conversion Apparatus," U.S. Pat. No. 3,088,997 (May 7, 1963).

Figure 4B:
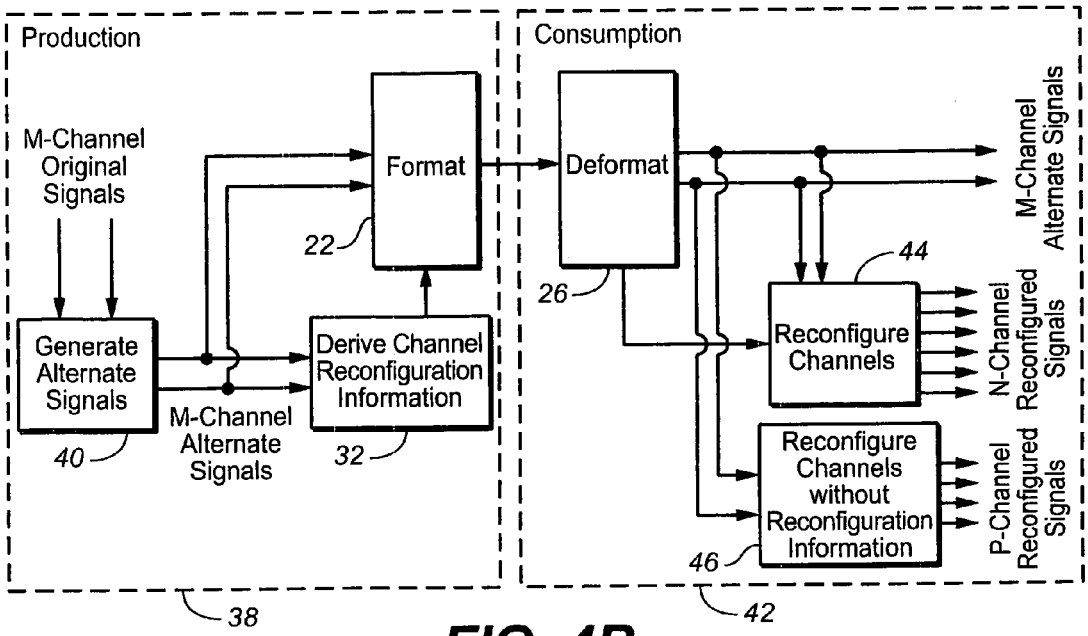
FIG. 4B is a functional schematic block diagram of another generalized channel reconfiguration embodiment of aspects of the present invention in which instructions for channel reconfiguration are derived in a production portion and the instructions are applied in a consumption portion. The signals applied to the production portion may be modified to improve their channel reconfiguration when such reconfiguration is performed in the consumption portion without reference to the instructions for channel reconfiguration.

As mentioned above in connection with the examples of FIG. 3 and FIG. 4A, a modified version of the M-Channel Original Signals may be employed as inputs. The signals are modified so as to facilitate a blind reconfiguration by a commonly-available consumer device such as an active matrix decoder. Alternatively, when the unmodified signals are two-channel stereophonic signals, the modified signals may be a two-channel binauralized version of the unmodified signals. The modified M-Channel Original Signals may have the same number of channels as the unmodified signals, although this is not critical to this aspect of the invention. Referring to the example of FIG. 4B, in the Production portion 38 of the arrangement, M-Channel Original Signals (legacy audio signals) are applied to a device or function that generates an alternate or modified set of audio signals ("Generate Alternate Signals") 40, which alternate or modified signals are applied to a device or function that derives one or more sets of channel reconfiguration side information ("Derive Channel Reconfiguration Information") 32 and to a formatter device or formatting function ("Format") 22 (both 32 and 22 are described above). The Derive Channel Reconfiguration Information 32 may also receive non-audio information from the Generate Alternate Signals 40 to assist it in deriving the reconfiguration information. The output bitstream or bitstreams are transmitted or stored in any suitable manner.

In the Consumption portion 42 of the arrangement, the output bitstream or bitstreams are received and a Deformat 26 (described above) undoes the action of the Format 22 to provide the M-Channel Alternate Signals (or an approximation of them) and the channel reconfiguration information. The channel reconfiguration information and the M-Channel Alternate Signals (or an approximation of them) may be applied to a device or function ("Reconfigure Channels") 44 that channel reconfigures the M-Channel Original Signals (or an approximation of them) in accordance with the instructions to provide N-Channel Reconfigured Signals. As in the FIGS. 3 and 4A examples, if there are multiple sets of instructions, one set is chosen (such choice may be fixed in the Consumption portion of the arrangement or it may be selectable in some manner). As noted above in the description of the FIG. 4A example, the "channel reconfiguration" may include, for example, "upmixing" (including virtual upmixing in which a two-channel binaural signal is rendered having upmixed virtual channels), "downmixing", spatial location reconfiguration, and conversion from binaural to loudspeaker format or from loudspeaker format to binaural. The M-Channel Alternate Signals (or an approximation of them) may also be applied to a device or function that reconfigures the M-Channel Alternate Signals without reference to the reconfiguration information ("Reconfigure Channels Without Reconfiguration Information") 46 to provide P-Channel Reconfigured Signals. The number of channels P need not be the same as the number of channels N. As discussed above, such a device or function 46 may be, in the case when the reconfiguration is upmixing, for example, a blind upmixer such as an active matrix decoder (examples of which are set forth above). The device or function 46 may also provide conversion from binaural to loudspeaker format or from loudspeaker format to binaural. As with device or function 36 of the FIG. 4A example, the device or function 46 may provide a virtual upmixing and/or a virtual loudspeaker repositioning in which a two-channel binaural signal is rendered having upmixed and/or repositioned virtual channels. The M-Channel Alternate Signals, the N-Channel Reconfigured Signals, and the P-Channel Reconfigured Signals are potential outputs of the Consumption portion 42 of the arrangement. Any combination of them may be provided as outputs (the figure shows all three) or one or a combination of them may be selected, the selection being implemented by a selector or selection function (not shown) under automatic or manual control, for example, by a user or consumer.

Figure 4C:
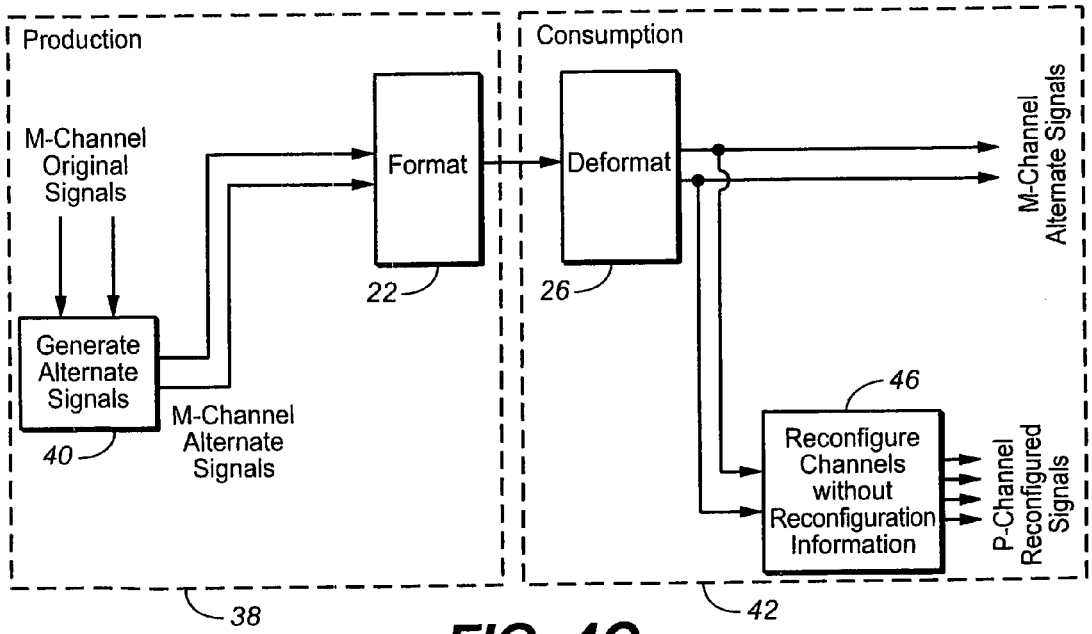
FIG. 4C is a functional schematic block diagram of another generalized channel reconfiguration embodiment of aspects of the present invention. The signals applied to the production portion are modified to improve their channel reconfiguration when such reconfiguration is performed in the consumption portion without reference to the instructions for channel reconfiguration. The reconfiguration information is not sent from the production portion to the consumption portion.

A further alternative is shown in the example of FIG. 4C. In this example, M-Channel Original Signals are modified, but the Channel Reconfiguration Information is not transmitted or recorded. Thus, the Derive Channel Reconfiguration Information 32 may be omitted in the Production portion 38 of the arrangement such that only the M-Channel Alternate Signals are applied to Format 22. Thus, a legacy transmission or recording arrangement, which may be incapable of carrying reconfiguration information in addition to audio information, is required to carry only a legacy-type signal, such as a two-channel stereophonic signal, which, in this case, has been modified to provide better results when applied to a low-complexity consumer-type upmixer, such as an active matrix decoder. In the Consumption portion 42 of the arrangement, the Reconfigure Channels 44 may be omitted in order to provide one or both of the two potential outputs, the M-Channel Alternate Signals and the P-Channel Reconfigured Signals.

As indicated above, it may be desirable to modify the set of M-Channel Original Signals applied to the Production portion of an audio system so that such M-Channel Original Signals (or an approximation of them) is more suitable for blind upmixing in the Consumption portion of the system by a consumer-type upmixer, such as an adaptive matrix decoder.

One way to modify such a set of non-optimal audio signals is to (1) upmix the set of signals using a device or function that operates with less dependence on intrinsic signal characteristics (such as amplitude and/or phase relationships among signals applied to it) than does an adaptive matrix decoder, and (2) encode the upmixed set of signals using a matrix encoder compatible with the anticipated adaptive matrix decoder. This approach is described below in connection with the example of FIG. 5A.

Another way to modify such a set of signals is to apply one or more of known "spatialization" and/or signal synthesis techniques. Ones of such techniques are sometimes characterized as "pseudo stereo" or "pseudo quad" techniques. For example, one may add decorrelated and/or out-of-phase content to one or more of the channels. Such processing increases apparent sound image width or sound envelopment at the cost of diminished center image stability. This is described in connection with the example of FIG. 5B. To help reach a balance between these signal features (width/envelopment versus center image stability), one could take advantage of the phenomenon that center image stability is determined mainly by low to mid frequencies, while image width and envelopment is determined mainly by higher frequencies. By splitting the signal into two or more frequency bands, one could process audio subbands independently so as maintain image stability at low and moderate frequencies by applying minimal decorrelation, and increase the sense of envelopment at higher frequencies by employing greater decorrelation. This is described in the example of FIG. 5C.

Figure 5A:
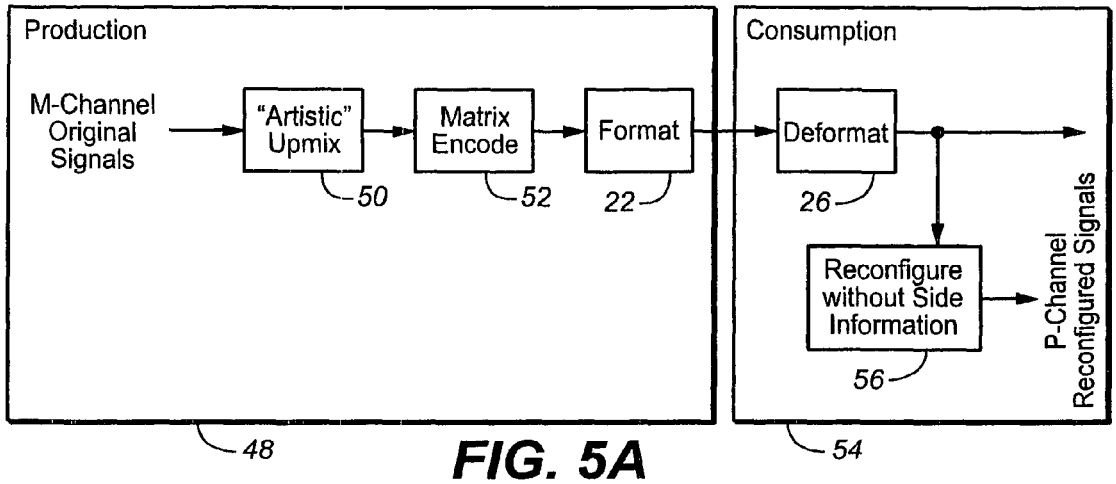
FIG. 5A is a functional schematic block diagram of an arrangement in which the production portion modifies the signals applied by employing an upmixer or upmixing function and a matrix encoder or matrix encoding function.

Referring to the example of FIG. 5A, in the Production portion 48 of the arrangement, M-Channel Signals are upmixed to P-Channel Signals by what may be characterized as an "artistic" upmixer device or "artistic" upmixing function (Artistic Upmix) 50. An "artistic" upmixer, typically, but not necessarily, a computationally complex upmixer, operates with little or no dependence on intrinsic signal characteristics (such as amplitude and/or phase relationships among signals applied to it) on which active matrix decoders rely to perform an upmix. Instead, an "artistic" upmixer operates in accordance with one or more processes that the designer or designers of the upmixer deem suitable to produce particular results. Such "artistic" upmixers may take many forms. One example is provided herein in connection with FIG. 7 and the description under the heading "The present invention applied to a spatial coder". According to this FIG. 7 example, the result is an upmixed signal with, for example, better left/right separation to minimize "center pile-up," or more front/back separation to improve "envelopment." The choice of a particular technique or techniques for performing an "artistic" upmix is not critical to this aspect of the invention.

Still referring to FIG. 5A, the upmixed P-Channel Signals are applied to a matrix encoder or matrix encoding function ("Matrix Encode") 52 that provides a smaller number of channels, the M-Channel Alternate Signals, which channels are encoded with intrinsic signal characteristics, such as amplitude and phase cues, suitable for decoding by a matrix decoder. A suitable matrix encoder is the 5:2 matrix encoder described below in connection with FIG. 8. Other matrix encoders may also be suitable. The Matrix Encode output is applied to the Format 22 that generates, for example, a serial or parallel bitstream, as described above. Ideally, the combination of Artistic Upmix 50 and the Matrix Encode 52 results in the generation of signals, which when decoded by a conventional consumer active matrix decoder, provides an improved listening experience in comparison to a decoding of the original signals applied to Artistic Upmix 50.

In the Consumption portion 54 of the FIG. 5A arrangement, the output bitstream or bitstreams are received and a Deformat 26 (described above) undoes the action of the Format 22 to provide the M-Channel Alternate Signals (or an approximation of them). The M-Channel Alternate Signals (or an approximation of them) may be provided as an output and applied to a device or function that reconfigures the M-Channel Alternate Signals without reference to any reconfiguration information ("Reconfigure Channels Without Reconfiguration Information") 56 to provide P-Channel Reconfigured Signals. The number of channels P need not be the same as the number of channels M. As discussed above, such a device or function 56 may be, in the case when the reconfiguration is upmixing, for example, a blind upmixer such as an active matrix decoder (as discussed above). The M-Channel Alternate Signals and the P-Channel Reconfigured Signals are potential outputs of the Consumption portion 54 of the arrangement. One or both of them may be selected, the selection being implemented by a selector or selection function (not shown) under automatic or manual control, for example, by a user or consumer.

Figure 5B:
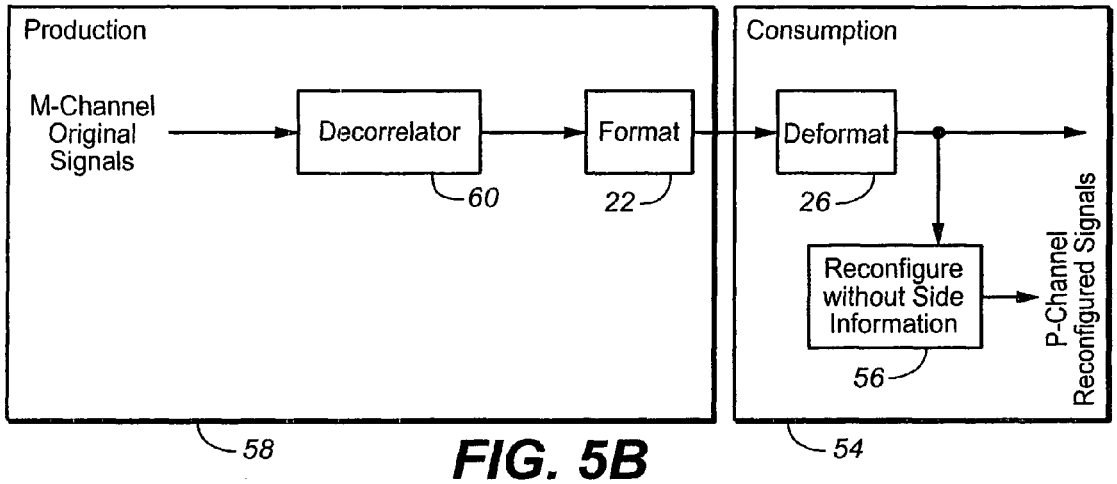
FIG. 5B is a functional schematic block diagram of an arrangement in which the production portion modifies the signals applied by reducing their cross correlation.

In the example of FIG. 5B, another way to modify a non-optimum set of input signals is shown, namely a type of "spatialization" in which the correlation among channels is modified. In the Production portion 58 of the arrangement, M-Channel Signals are applied to a set of decorrelator devices or decorrelation functions ("Decorrelator") 60. A reduction in cross correlation between or among the signal channels can be achieved by independently processing the individual channels with any of the well know decorrelation techniques. Alternatively, decorrelation can be achieved by interdependently processing between or among channels. For example, out of phase content (i.e., negative correlation) between channels can be achieved by scaling and inverting the signal from one channel and mixing into another. In both cases, the process can be controlled by adjusting the relative levels of processed and unprocessed signal in each channel. As mentioned above, there is a trade off between apparent sound image width or sound envelopment and diminished center image stability. An example of decorrelation by independently processing individual channels is set forth in the pending U.S. patent applications of Seefeldt et al, Ser. No. 60/604,725 (filed Aug. 25, 2004), Ser. No. 60/700,137 (filed Jul. 18, 2005), and Ser. No. 60/705,784 (filed Aug. 5, 2005, each entitled "Multichannel Decorrelation in Spatial Audio Coding." Another example of decorrelation by independently processing individual channels is set forth in the Breebaart et al AES Convention Paper 6072 and the WO 03/090206 international application, cited below. The M-Channel Signals with decreased correlation are applied to Format 22, as described above, which provides a suitable output, such as one or more bitstreams, for application to a suitable transmission or recording. The Consumption portion 54 of the FIG. 5B arrangement may be the same as the Consumption portion of the FIG. 5A arrangement.

Figure 5C:
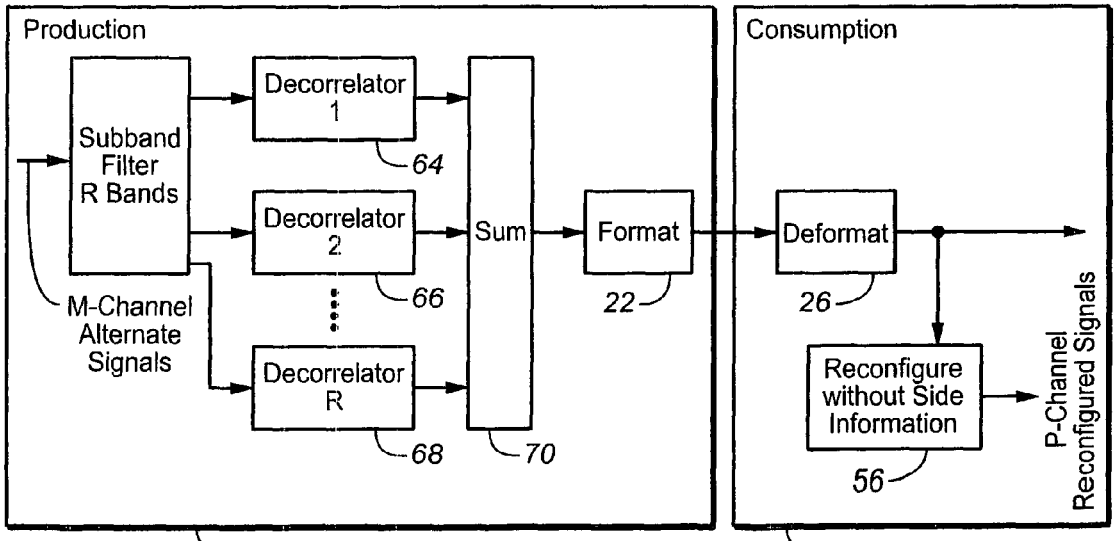
FIG. 5C is a functional schematic block diagram of an arrangement in which the production portion modifies the signals applied by reducing their cross correlation on a subband basis.

As mentioned above, adding decorrelated and/or out-of-phase content to one or more of the channels increases apparent sound image width or sound envelopment at the cost of diminished center image stability. In the example of FIG. 5C, to help reach a balance between width/envelopment versus center image stability, signals are split into two or more frequency bands and the audio subbands are processed independently so as maintain image stability at low and moderate frequencies by applying minimal decorrelation, and increase the sense of envelopment at higher frequencies by employing greater decorrelation.

Referring to FIG. 5C, in the production portion 58', M-Channel Signals are applied to a subband filter or subband filtering function ("Subband Filter") 62. Although FIG. 5C shows such a Subband Filter 62 explicitly, it should be understood that such a filter or filtering function may be employed in other examples, as mentioned above. Although Subband Filter 62 may take various forms and the choice of the filter or filtering function (e.g., a filter bank or a transform) is not critical to the invention. Subband Filter 62 divides the spectrum of the M-Channel Signals into R bands, each of which may be applied to a respective Decorrelator. The drawing shows, schematically, Decorrelator 64 for band 1, Decorrelator 66 for band 2, and Decorrelator 68 for band R, it being understood that each band may have its own Decorrelator. Some bands may not be applied to a Decorrelator. The Decorrelators are essentially the same as Decorrelator 60 of the FIG. 5B example except that they operate on less than the full spectrum of the M-Channel Signals. For simplicity in presentation, FIG. 5C shows a Subband Filter and related Decorrelators for a single signal, it being understood that each signal is split into subbands and that each subband may be decorrelated. After decorrelation, if any, the subbands for each signal may be summed together by a summer or summing function ("Sum") 70 The Sum 70 output is applied to the Format 22 that generates, for example, a serial or parallel bitstream, as described above. The Consumption portion 54 of the FIG. 5C arrangement may be the same as the Consumption portion of the FIGS. 5A and 5B arrangements.

Integration with Spatial Coding

Certain recently-introduced limited bit rate coding techniques (see below for an exemplary list of patents, patent applications and publications relating to spatial coding) analyze an N channel input signal along with an M channel composite signal (N>M) to generate side-information containing a parametric model of the N channel input signal's sound field with respect to that of the M channel composite. Typically the composite signal is derived from the same master material as the original N channel signal. The side-information and composite signal are transmitted to a decoder that applies the parametric model to the composite signal in order to recreate an approximation of the original N channel signal's sound field. The primary goal of such "spatial coding" systems is to recreate the original sound field with a very limited amount of data; hence this enforces limitations on the parametric model used to simulate the original sound field. Such spatial coding systems typically employ parameters to model the original N channel signal's sound field such as inter-channel level differences (ILD), inter-channel time or phase differences (ITD or IPD), and inter-channel coherence (ICC). Typically such parameters are estimated for multiple spectral bands across all N channels of the input signal being coded and are dynamically estimated over time.

Figure 6A:
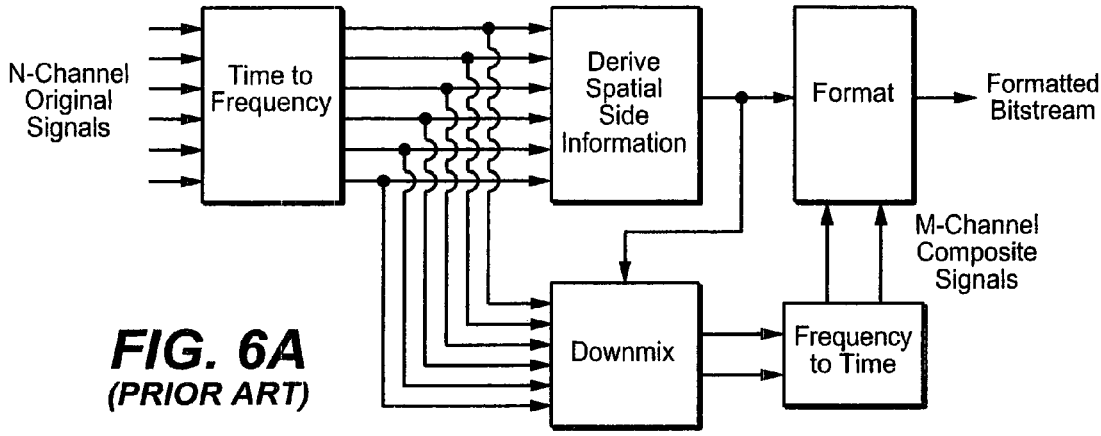
FIG. 6A (PRIOR ART)
FIG. 6A is a functional schematic block diagram showing an example of a prior art encoder in a spatial coding system in which the encoder receives N-Channel signals that are desired to be reproduced by the decoder in the spatial coding system.
Figure 6B:
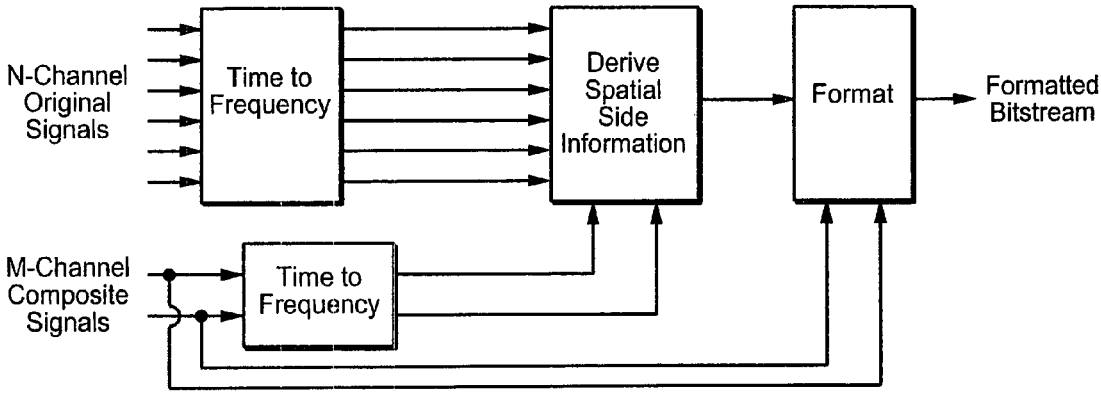
FIG. 6B (PRIOR ART)
FIG. 6B is a functional schematic block diagram showing an example of a prior art encoder in a spatial coding system in which the encoder receives N-channel signals that are desired to be reproduced by the decoder in the spatial coding system and it also receives the M-channel composite signals that are sent from the encoder to the decoder.

Some examples of prior art spatial coding are shown in FIGS. 6A-6B (encoder) and 6C (decoder). N-Channel Original Signals may be converted by a device or function ("Time to Frequency") to the frequency domain utilizing an appropriate time-to-frequency transformation, such as the well-known Short-time Discrete Fourier Transform (STDFT). Typically, the transform is manipulated such that its frequency bands approximate the ear's critical bands. An estimate of the inter-channel amplitude differences, inter-channel time or phase differences, and inter-channel correlation is computed for each of the bands ("Generate Spatial Side Information). If M-Channel Composite Signals corresponding to the N-Channel Original Signals do not already exist, these estimates may be utilized to downmix ("Downmix") the N-Channel Original Signals into M-Channel Composite Signals (as in the example of FIG. 6A). Alternatively, an existing M channel composite may be simultaneously processed with the same time-to-frequency transform (shown separately for clarity in presentation) and the spatial parameters of the N-Channel Original Signals may be computed with respect to those of the M-Channel Composite Signals (as in the example of FIG. 6B). Similarly, if N-Channel Original Signals are not available, an available set of M-Channel Composite Signals may be upmixed in the time domain to produce the "N-Channel Original Signals—each set of signals providing a set of inputs to the respective Time to Frequency devices or functions in the example of FIG. 6B. The composite signal and the estimated spatial parameters are then encoded ("Format") into a single bitstream. At the decoder (FIG. 6C), this bitstream is decoded ("Deformat") to generate the M-Channel Composite Signals along with the spatial side information. The composite signals are transformed to the frequency domain ("Time to Frequency") where the decoded spatial parameters are applied to their corresponding bands ("Apply Spatial Side Information") to generate an N-Channel Original Signals in the frequency domain. Finally, a frequency-to-time transformation ("Frequency to Time") is applied to produce the N-Channel Original Signals or approximations thereof. Alternatively, the spatial side information may be ignored and the M-Channel Composite Signals selected for playback.

While prior art spatial coding systems assume the existence of N-channel signals from which a low-data rate parametric representation of its sound field is estimated, such a system may be altered to work with the disclosed invention. Rather than estimate spatial parameters from original N-channel signals, such spatial parameters may instead be generated directly from an analysis of legacy M channel signals, where M<N. The parameters are generated such that a desired N-channel upmix of the legacy M-channel signals is produced at the decoder when such parameters are there applied. This may be achieved without generating the actual N-channel upmix signals at the encoder, but rather by producing a parametric representation of the desired upmixed signal's sound field directly from the M-channel legacy signals. FIG. 7 depicts such an upmixing encoder, which is compatible with the spatial decoder depicted in FIG. 6C. Further details of producing such a parametric representation are provided below under the heading "The present invention applied to a spatial coder."

Referring to the details of FIG. 7, M-Channel Original Signals in the time domain are converted to the frequency domain utilizing an appropriate time-to-frequency transformation ("Time to Frequency") 72. A device or function 74 ("Derive Upmix Information as Side Information") derives upmixing instructions in the same manner that spatial side information is generated in a spatial coding system. Details of generating spatial side information in a spatial coding system are set forth in one or more of the references cited herein. The spatial coding parameters, constituting upmix instructions, along with the M-Channel Original Signals are applied to a device or function ("Format") 76 that formats the M-Channel Original Signals and the spatial coding parameters into a form suitable for transmission or storage. The formatting may include data-compression encoding.

Figure 6C:
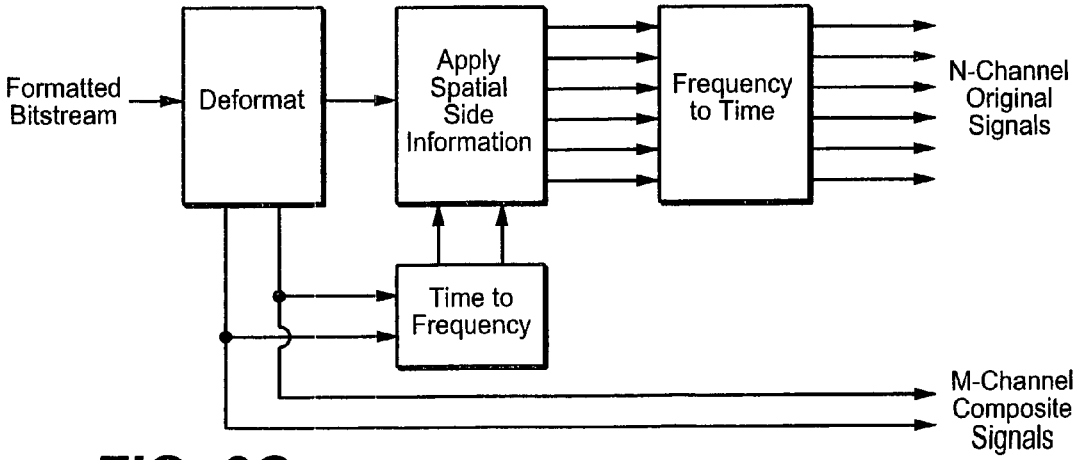
FIG. 6C (PRIOR ART)
FIG. 6C is a functional schematic block diagram showing an example of a prior art decoder in a spatial coding system that is usable with the encoder of FIG. 6A or the encoder of FIG. 6B.
Figure 7:
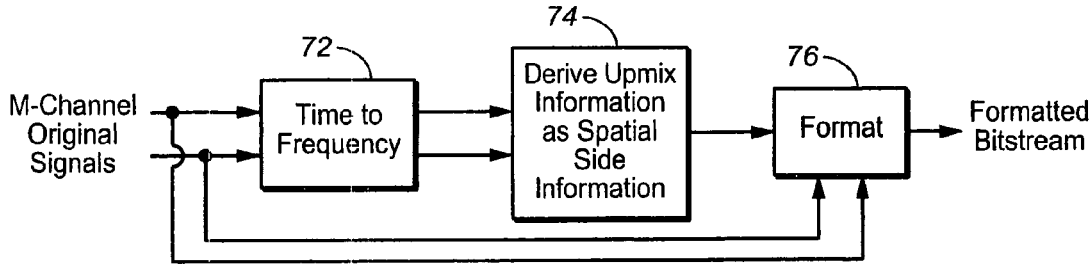
FIG. 7 is a functional schematic block diagram of an embodiment of an encoder embodiment of aspects of the present invention usable in a spatial coding system.

An upmixer employing the parameter generation as just described in combination with a device or function for applying them to the signals to be upmixed as, for example, a FIG. 6C decoder, is suitable as a computationally-complex upmixer for use in generating alternate signals as in the examples of FIGS. 4B 4C, 5A and 5B.

Although it is advantageous to produce the parametric representation directly from the M-channel legacy signals without generating the desired N-channel upmix signals at the encoder (as in the example below), it is not crucial to the invention. Alternatively, spatial parameters may be derived by generating the desired N-channel upmix signals at the encoder. Functionally, such signals would be generated within block 74 of FIG. 7. Thus, even in this alternative, the only audio information that the instruction deriving receives is the M-channel legacy signals.

Figure 8:
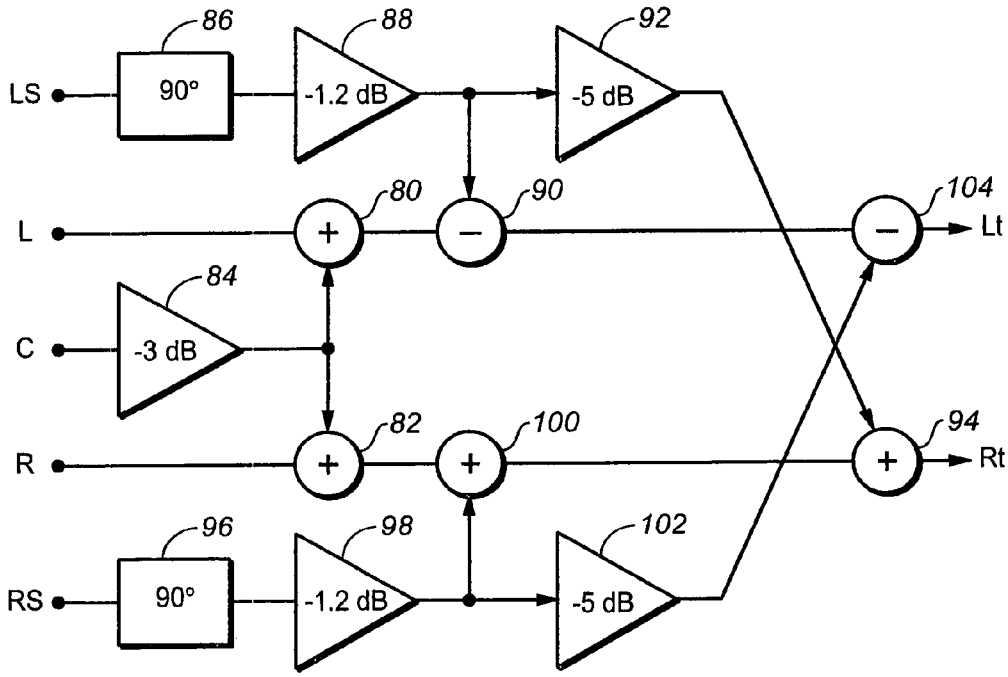
FIG. 8 is a functional block diagram showing an idealized prior art 5:2 matrix encoder suitable for use with a 2:5 active matrix decoder.

FIG. 8 is an idealized functional block diagram of a conventional prior art 5:2 matrix passive (linear time-invariant) encoder compatible with Pro Logic II active matrix decoders. Such an encoder is suitable for use in the example of FIG. 5A, described above. The encoder accepts five separate input signals; left, center, right, left surround, and right surround (L, C, R, LS, RS), and creates two final outputs, left-total and right-total (Lt and Rt). The C input is divided equally and summed with the L and R inputs (in combiners 80 and 82, respectively) with a 3 dB level (amplitude) attenuation (provided by attenuator 84) in order to maintain constant acoustic power. The L and R inputs, each summed with the level-reduced C input, have phase- and level-shifted versions of the LS and RS inputs subtractively and additively combined with them. The left-surround (LS) input ideally is phase shifted by 90 degrees, shown in block 86, and then reduced in level by 1.2 dB in attenuator 88 for subtractive combining in combiner 90 with the summed L and level-reduced C. It is then further reduced in level by 5 dB in attenuator 92 for additive combining in combiner 94 with the summed R, level-reduced C, and a phase-shifted level-reduced version of RS, as next described, to provide the Rt output. The right-surround (RS) input ideally is phase shifted by 90 degrees, shown in block 96, and then reduced in level by 1.2 dB in attenuator 98 for additive combining in combiner 100 with the summed R and level-reduced C. It is then further reduced in level by 5 dB in attenuator 102 for subtractive combining in combiner 104 with the summed R, level-reduced C, and level-reduced phase-shifted LS to provide the Lt output.

In principle there need be only one 90 degree phase-shift block in each surround input path, as shown in the figure. In practice, a 90 degree phase shifter is unrealizable, so four all-pass networks may be used with appropriate phase shifts so as to realize the desired 90 degree phase shifts. All-pass networks have the advantage of not affecting the timbre (frequency spectrum) of the audio signals being processed.

The left-total (Lt) and right-total (Rt) encoded signals may be expressed as $$Lt=L+m(-3)\text{dB}*C-j*[m(-1.2)\text{dB}*Ls+m(-6.2)\text{dB}*Rs], \text{ and}$$

$$Rt=R+m(-3)\text{dB}*C+j*[(m(-1.2)\text{dB}*Rs+m(-6.2)\text{dB}*Ls),$$

where L is the left input signal, R is the right input signal, C is the center input signal, Ls is the left surround input signal, Rs is the right surround input signal, "j is the square root of minus one (−1) (a 90 degree phase shift), and "m" indicates multiply by the indicated attenuation in decibels (thus, m(−3) dB=3 dB attenuation).

Alternatively, the equations may be expressed as follows:

$$Lt=L+(0.707)*C-j*(0.87*Ls+0.56*Rs), \text{ and}$$

$$Rt=R+(0.707)*C+j*(0.87*Rs+0.56*Ls),$$

where, 0.707 is an approximation of 3 dB attenuation, 0.87 is an approximation of 1.2 dB attenuation, and 0.56 is an approximation of 6.2 dB attenuation. The values (0.707, 0.87, and 0.56) are not critical. Other values may be employed with acceptable results. The extent to which other values may be employed depends on the extent to which the designer of the system deems the audible results to be acceptable.

DETAILED DESCRIPTION OF THE PREFERRED EMBODIMENTS

Spatial Coding Background

Consider a spatial coding system that utilizes as its side information per-critical band estimates of the inter-channel level differences (ILD) and inter-channel coherence (ICC) of the N channel signal. We assume the number of channels in the composite signal is M=2 and that the number of channels in the original signal is N=5. Define the following notation:

- $X_j[b,t]$: The frequency domain representation of channel j of composite signal x at band b and time block t. This value is derived by applying a time to frequency transform to the composite signal x sent to the decoder.
- $Z_i[b,t]$: The frequency domain representation of channel i of original signal estimate z at band b and time block t. This value is computed by applying the side information to $X_j[b,t]$.
- $ILD_{ij}[b,t]$: The inter-channel level difference of channel i of the original signal with respect to channel j of the composite at band b and time block t. This value is sent as side information.
- $ICC_i[b,t]$: The inter-channel coherence of channel i of the original signal at band b and time block t. This value is sent as side information.

As a first step in decoding, an intermediate frequency domain representation of the N channel signal is generated through application of the inter-channel level differences to the composite as follows:

$$Y_i[b,t]=\sum_{j=1}^{2} ILD_{ij}[b,t]X_j[b,t]$$

Next a decorrelated version of $Y_i$ is generated through application of a unique decorrelation filter $H_i$ to each channel i, where application of the filter may be achieved through multiplication in the frequency domain:

$$\hat{Y}_i=H_iY_i$$

Lastly, the frequency domain estimate of the original signal z is computed as a linear combination of $Y_i$ and $\hat{Y}_i$, where the inter-channel coherence controls the proportion of this combination:

$$Z_i[b,t]=ICC_i[b,t]Y_i[b,t]+\sqrt{1-ICC_i^2[b,t]}\hat{Y}_i[b,t]$$

The final signal z is then generated by applying a frequency to time transformation to $Z_i[b,t]$.

The Present Invention Applied to a Spatial Coder

We now describe an embodiment of the disclosed invention that utilizes the spatial decoder described above in order to upmix an M=2 channel signal into an N=6 channel signal. The encoding requires synthesizing the side information $ILD_{ij}[b,t]$ and $ICC_i[b,t]$ from $X_j[b,t]$ alone such that the desired upmix is produced at the decoder when $ILD_{ij}[b,t]$ and $ICC_i[b,t]$ are applied to $X_j[b,t]$, as described above. As indicated above, this approach also applies provides a computationally-complex upmixing suitable for use, when the upmixed signals are then applied to a matrix encoder, in generating alternate signals suitable for upmixing by a low-complexity upmixer such a consumer-type active matrix decoder.

The first step of the preferred blind upmixing system is to convert the two-channel input into the spectral domain. The conversion to the spectral domain may be accomplished using 75% overlapped DFTs with 50% of the block zero padded to prevent circular convolutional effects caused by the decorrelation filters. This DFT scheme matches the time-frequency conversion scheme used in the preferred embodiment of the spatial coding system. The spectral representation of the signal is then separated into multiple bands approximating the equivalent rectangular band (ERB) scale; again, this banding structure is the same as the one used by the spatial coding system such that the side-information may be used to perform blind upmixing at the decoder. In each band b a covariance matrix is calculated as shown in the following equation:

$$R_{XX}^{b,t}=\begin{bmatrix} X_1[k,t] & \cdots & X_1[k+W,t] \\ X_2[k,t] & \cdots & X_2[k+W,t] \end{bmatrix}\begin{bmatrix} X_1[k,t]^* & X_2[k,t]^* \\ \vdots & \vdots \\ X_1[k+W,t]^* & X_2[k+W,t]^* \end{bmatrix}$$

Where, $X_i[k,t]$ is the DFT of the first channel at bin k and block t, $X_2[k,t]$ is the DFT of the second channel at bin k and block t, W is the width of the band b counted in bins, and $R_{XX}^{b,t}$ is an instantaneous estimate of the covariance matrix in band b at block t for the two input channels. Furthermore, the "*" operator in the above equation represents the conjugation of the DFT values.

The instantaneous estimate of the covariance matrix is then smoothed over each block using a simple first order IIR filter applied to the covariance matrix in each band as shown in the following equation:

$$\tilde{R}_{XX}^{b,t}=\lambda\tilde{R}_{XX}^{b,t-1}+(1-\lambda)R_{XX}^{b,t}$$

Where, $\tilde{R}_{XX}^{b,t}$ is a smoothed estimate of the covariance matrix, and A is the smoothing coefficient, which may be signal and band dependent.

For a simple 2 to 6 blind upmixing system we define the channel ordering as follows:

| Channel | Enumeration |
|---|---|
| Left | 1 |
| Center | 2 |
| Right | 3 |
| Left Surround | 4 |
| Right Surround | 5 |
| LFE | 6 |

Using the above channel mapping we develop the following per band ILD and ICC for each of the channels with respect to the smoothed covariance matrix:

Define: $a^{b,t}=|\hat{R}_{XX}^{b,t}[1,2]|$

Then for channel 1 (Left):

$$ILD_{1,1}[b,t]=\sqrt{1-(a^{b,t})^2}$$

$$ILD_{1,2}[b,t]=0$$

$$ICC_1[b,t]=1$$

For channel 2 (Center):

$$ILD_{2,1}[b,t]=0$$

$$ILD_{2,2}[b,t]=0$$

$$ICC_2[b,t]=1$$

For Channel 3 (Right):

$$ILD_{3,1}[b,t]=0$$

$$ILD_{3,2}[b,t]=\sqrt{1-(a^{b,t})^2}$$

$$ICC_3[b,t]=1$$

For channel 4 (Left Surround):

$$ILD_{4,1}[b,t]=a^{b,t}$$

$$ILD_{4,2}[b,t]=0$$

$$ICC_4[b,t]=0$$

For channel 5 (Right Surround):

$$ILD_{5,1}[b,t]=0$$

$$ILD_{5,2}[b,t]=a^{b,t}$$

$$ICC_5[b,t]=0$$

For channel 6 (LFE):

$$ILD_{6,1}[b,t]=0$$

$$ILD_{6,2}[b,t]=0$$

$$ICC_6[b,t]=1$$

In practice, an arrangement according to the just-describe example has been found to perform well—it separates direct sounds from ambient sounds, puts direct sounds into the Left and Right channels, and moves the ambient sounds to the rear channels. More complicated arrangements may also be created using the side information transmitted within a spatial coding system.

Incorporation By Reference

The following patents, patent applications and publications are hereby incorporated by reference, each in their entirety.

Virtual Sound Processing

Atal et al, "Apparent Sound Source Translator," U.S. Pat. No. 3,236,949 (Feb. 26, 1966).

Bauer, "Stereophonic to Binaural Conversion Apparatus," U.S. Pat. No. 3,088,997 (May 7, 1963).

AC-3 (Dolby Digital)

*ATSC Standard A52/A: Digital Audio Compression Standard (AC-3), Revision A*, Advanced Television Systems Committee, 20 Aug. 2001. The A/52A document is available on the World Wide Web at http://www.atsc.org/standards.html.

"Design and Implementation of AC-3 Coders," by Steve Vernon, *IEEE Trans. Consumer Electronics*, Vol. 41, No. 3, August 1995.

"The AC-3 Multichannel Coder" by Mark Davis, Audio Engineering Society Preprint 3774, 95th AES Convention, October, 1993.

"High Quality, Low-Rate Audio Transform Coding for Transmission and Multimedia Applications," by Bosi et al, Audio Engineering Society Preprint 3365, 93rd AES Convention, October, 1992.

U.S. Pat. Nos. 5,583,962; 5,632,005; 5,633,981; 5,727,119; and 6,021,386.

Spatial Coding

United States Published Patent Application US 2003/0026441, published Feb. 6, 2003

United States Published Patent Application US 2003/0035553, published Feb. 20, 2003, United States Published Patent Application US 2003/0219130 (Baumgarte & Faller) published Nov. 27, 2003, Audio Engineering Society Paper 5852, March 2003

Published International Patent Application WO 03/090206, published Oct. 30, 2003

Published International Patent Application WO 03/090207, published Oct. 30, 2003

Published International Patent Application WO 03/090208, published Oct. 30, 2003

Published International Patent Application WO 03/007656, published Jan. 22, 2003

United States Published Patent Application Publication US 2003/0236583 A1, Baumgarte et al, published Dec. 25, 2003, "Hybrid Multichannel/Cue Coding/Decoding of Audio Signals," application Ser. No. 10/246,570.

"Binaural Cue Coding Applied to Stereo and Multichannel Audio Compression," by Faller et al, Audio Engineering Society Convention Paper 5574, 112$^{th}$ Convention, Munich, May 2002.

"Why Binaural Cue Coding is Better than Intensity Stereo Coding," by Baumgarte et al, Audio Engineering Society Convention Paper 5575, 112$^{th}$ Convention, Munich, May 2002.

"Design and Evaluation of Binaural Cue Coding Schemes," by Baumgarte et al, Audio Engineering Society Convention Paper 5706, 113$^{th}$ Convention, Los Angeles, October 2002.

"Efficient Representation of Spatial Audio Using Perceptual Parameterization," by Faller et al, IEEE Workshop on Applications of Signal Processing to Audio and Acoustics 2001, New Paltz, N.Y., October 2001, pp. 199-202.

"Estimation of Auditory Spatial Cues for Binaural Cue Coding," by Baumgarte et al, Proc. ICASSP 2002, Orlando, Fla., May 2002, pp. II-1801-1804.

"Binaural Cue Coding: A Novel and Efficient Representation of Spatial Audio," by Faller et al, Proc. ICASSP 2002, Orlando, Fla., May 2002, pp. II-1841-11-1844.

"High-quality parametric spatial audio coding at low bitrates," by Breebaart et al, Audio Engineering Society Convention Paper 6072, 116$^{th}$ Convention, Berlin, May 2004.

"Audio Coder Enhancement using Scalable Binaural Cue Coding with Equalized Mixing," by Baumgarte et al, Audio Engineering Society Convention Paper 6060, 116$^{th}$ Convention, Berlin, May 2004.

"Low complexity parametric stereo coding," by Schuijers et al, Audio Engineering Society Convention Paper 6073, 116$^{th}$ Convention, Berlin, May 2004.

"Synthetic Ambience in Parametric Stereo Coding," by Engdegard et al, Audio Engineering Society Convention Paper 6074, 116$^{th}$ Convention, Berlin, May 2004.

Other

U.S. Pat. No. 6,760,448, of Kenneth James Gundry, entitled "Compatible Matrix-Encoded Surround-Sound Channels in a Discrete Digital Sound Format."

U.S. patent application Ser. No. 10/911,404 of Michael John Smithers, filed Aug. 3, 2004, entitled "Method for Combining Audio Signals Using Auditory Scene Analysis"

U.S. Patent Applications of Seefeldt et al, Ser. No. 60/604,725 (filed Aug. 25, 2004), Ser. No. 60/700,137 (filed Jul. 18, 2005), and Ser. No. 60/705,784 (filed Aug. 5, 2005, each entitled "Multichannel Decorrelation in Spatial Audio Coding."

Published International Patent Application WO 03/090206, published Oct. 30, 2003.

"High-quality parametric spatial audio coding at low bitrates," by Breebaart et al, Audio Engineering Society Convention Paper 6072, 116$^{th}$ Convention, Berlin, May 2004.

Implementation

The invention may be implemented in hardware or software, or a combination of both (e.g., programmable logic arrays). Unless otherwise specified, the algorithms included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein. A number of embodiments of the invention have been described. Nevertheless, it will be understood that various modifications may be made without departing from the spirit and scope of the invention. For example, some of the steps described herein may be order independent, and thus can be performed in an order different from that described.

We claim:

1. A method for processing two or more audio signals, each audio signal representing an audio channel, comprising deriving instructions for channel reconfiguring the two or more audio signals without changing the configuration of the two or more audio signals, wherein the only audio information that said deriving receives is said two or more audio signals, and generating a formatted output that includes the two or more audio signals with unchanged channel configuration, such that the two or more audio signals with unchanged channel configuration are unchanged with respect to the number of audio channels, the intended spatial location of the audio channels, and the format of the audio channels, and the formatted output includes said instructions for channel reconfiguring.

2. The method of claim 1 wherein the audio signals are a stereophonic pair of audio signals.

3. The method of claim 1 wherein said deriving instructions for channel reconfiguring derives instructions for upmixing the two or more audio signals such that, when upmixed in accordance with the instructions for upmixing, the resulting number of audio signals is greater than the number of audio signals comprising the two or more audio signals.

4. The method of claim 1 wherein said deriving instructions for channel reconfiguring derives instructions for downmixing the two or more audio signals such that, when downmixed in accordance with the instructions for downmixing, the resulting number of audio signals is less than the number of audio signals comprising the two or more audio signals.

5. The method of claim 1 wherein said deriving instructions for channel reconfiguring derives instructions for reconfiguring the two or more audio signals such that, when reconfigured in accordance with the instructions for reconfiguring, the number of audio signals remains the same but one or more spatial locations at which such audio signals are intended to be reproduced are changed.

6. The method of claim 1 wherein the two or more audio signals in the output is a data-compressed version of the two or more audio signals, respectively.

7. The method of claim 1 wherein said two or more audio signals are divided into frequency bands and said instructions for channel reconfiguring are with respect to ones of such frequency bands.

8. The method of claim 1 wherein the audio signals are a binauralized version of a stereophonic pair of audio signals.

9. A method for processing two or more audio signals, each audio signal representing an audio channel, comprising receiving, in a formatted output from an audio processor, said two or more audio signals and instructions for channel reconfiguring the two or more audio signals, said instructions having been derived by an instruction derivation in which the only audio information received is said two or more audio signals and the instruction derivation does not change the configuration of the two or more signals, said two or more audio signals having an unchanged channel configuration with respect to the channel configuration of the two or more signals received by the instruction derivation, such that the two or more audio signals with unchanged channel configuration are unchanged with respect to the number of audio channels, the intended spatial location of the audio channels, and the format of the audio channels, and channel reconfiguring the two or more audio signals using said instructions.

10. The method of claim 9 wherein the instructions for channel reconfiguring are instructions for upmixing the two or more audio signals and said channel reconfiguring upmixes the two or more audio signals such that the resulting number of audio signals is greater than the number of audio signals comprising the two or more audio signals.

11. The method of claim 9 wherein the instructions for channel reconfiguring are instructions for downmixing the two or more audio signals and said channel reconfiguring downmixes the two or more audio signals such that the resulting number of audio signals is less than the number of audio signals comprising the two or more audio signals.

12. The method of claim 9 wherein the instructions for channel reconfiguring are instructions for reconfiguring the two or more audio signals such that the number of audio signals remains the same but the respective spatial locations at which such audio signals are intended to be reproduced are changed.

13. The method of claim 9 wherein the instructions for channel reconfiguring are instructions for rendering a binaural stereophonic signal having an upmixing to multiple virtual channels of the two or more audio signals.

14. The method of claim 9 wherein the instructions for channel reconfiguring are instructions for rendering a binaural stereophonic signal having a virtual spatial location reconfiguration.

15. The method of claim 9 wherein the two or more audio signals are data-compressed, the method further comprising data decompressing the two or more audio signals.

16. The method of claim 9 wherein said two or more audio signals is divided into frequency bands and said instructions for channel reconfiguring are with respect to respective ones of such frequency bands.

17. The method of claim 9 further comprising providing an audio output, and selecting as the audio output one of:

(1) the at least two or more audio signals, or (2) the channel reconfigured two or more audio signals.

18. The method of claim 9 further comprising providing an audio output in response to the received two or more audio signals.

19. The method of claim 18 wherein the method further comprises matrix decoding the two or more audio signals.

20. The method of claim 9 further comprising providing an audio output in response to the channel-reconfigured received two or more audio signals.

21. A method for processing at least two audio signals, each audio signal representing an audio channel, comprising receiving, in a formatted output from an audio processor, said two or more audio signals and instructions for channel reconfiguring the two or more audio signals, said instructions having been derived by an instruction derivation in which the only audio information received is said two or more audio signals and the instruction derivation does not change the configuration of the two or more signals, said two or more audio signals having an unchanged channel configuration with respect to the channel configuration of the two or more signals received by the instruction derivation, such that the two or more audio signals with unchanged channel configuration are unchanged with respect to the number of audio channels, the intended spatial location of the audio channels, and the format of the audio channels, and matrix decoding the two or more audio signals.

22. The method of claim 21 wherein the matrix decoding is without reference to the received instructions.

23. The method of claim 21 wherein the matrix decoding is with reference to the received instructions.

24. Apparatus for processing two or more audio signals, each audio signal representing an audio channel, comprising means for deriving instructions for channel reconfiguring the two or more audio signals without changing the configuration of the two or more audio signals, wherein the only audio information that said means for deriving receives is said two or more audio signals, and means for generating a formatted output that includes the two or more audio signals with unchanged channel configuration such that the two or more audio signals with unchanged channel configuration are unchanged with respect to the number of audio channels, the intended spatial location of the audio channels, and the format of the audio channels, and the formatted output includes said instructions for channel reconfiguring.

25. Apparatus for processing two or more audio signals, each audio signal representing an audio channel, comprising means for deriving instructions for channel reconfiguring the two or more audio signals without changing the configuration of the two or more audio signals, wherein the only audio information that said means for deriving receives is said two or more audio signals, and means for generating a formatted output that includes the two or more audio signals with unchanged channel configuration such that the two or more audio signals with unchanged channel configuration are unchanged with respect to the number of audio channels, the intended spatial location of the audio channels, and the format of the audio channels, and the formatted output includes said instructions for channel reconfiguring, and means for receiving the output.

26. Apparatus for processing two or more audio signals, each audio signal representing an audio channel, comprising means for receiving, in a formatted output from an audio processor, said two or more audio signals and instructions for channel reconfiguring the two or more audio signals, said instructions having been derived by an instruction derivation in which the only audio information received is said two or more audio signals and the instruction derivation does not change the configuration of the two or more signals, said two or more audio signals having an unchanged channel configuration with respect to the channel configuration of the two or more signals received by the instruction derivation, such that the two or more audio signals with unchanged channel configuration are unchanged with respect to the number of audio channels, the intended spatial location of the audio channels, and the format of the audio channels, and means for channel reconfiguring the two or more audio signals using said instructions.

27. Apparatus for processing at least two audio signals, each audio signal representing an audio channel, comprising means for receiving, in a formatted output from an audio processor, said two or more audio signals and instructions for channel reconfiguring the two or more audio signals, said instructions having been derived by an instruction derivation in which the only audio information received is said two or more audio signals and the instruction derivation does not change the configuration of the two or more signals, said two or more audio signals having an unchanged channel configuration with respect to the channel configuration of the two or more signals received by the instruction derivation, such that the two or more audio signals with unchanged channel configuration are unchanged with respect to the number of audio channels, the intended spatial location of the audio channels, and the format of the audio channels, and means for matrix decoding the two or more audio signals.

* * * * *